US012352524B2

(12) United States Patent
St. Phillips et al.

(10) Patent No.: US 12,352,524 B2
(45) **Date of Patent: *Jul. 8, 2025**

(54) AIR GUN WITH AUTOMATIC COCKING

(71) Applicant: Crosman Corporation, Bloomfield, NY (US)

(72) Inventors: Eric A. St. Phillips, Fairport, NY (US); John A. Kowalczyk, Fairport, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/399,406

(22) Filed: Dec. 28, 2023

(65) Prior Publication Data

US 2024/0175656 A1 May 30, 2024

Related U.S. Application Data

(63) Continuation of application No. 17/696,632, filed on Mar. 16, 2022, now Pat. No. 11,859,939.

(51) Int. Cl.
*F41B 11/646* (2013.01)
*F41B 11/54* (2013.01)

(52) U.S. Cl.
CPC ..... *F41B 11/646* (2013.01); *F41B 11/54* (2013.01)

(58) Field of Classification Search
CPC ..... F41B 11/54; F41B 11/646
USPC ..... 124/67
See application file for complete search history.

(56) References Cited

U.S. PATENT DOCUMENTS

| | | | | |
|---|---|---|---|---|
| 4,899,717 | A | 2/1990 | Rutten et al. | |
| 10,197,355 | B2 | 2/2019 | Lamboy | |
| 10,267,593 | B2 | 4/2019 | Lamboy | |
| 11,859,939 | B2 * | 1/2024 | St. Phillips | F41B 11/71 |
| 2006/0185657 | A1 | 8/2006 | Gabrel | |
| 2007/0101982 | A1 | 5/2007 | Ong et al. | |
| 2009/0056693 | A1 | 3/2009 | Pedicini et al. | |
| 2013/0008421 | A1 | 1/2013 | Lee | |
| 2019/0063865 | A1 | 2/2019 | Victor et al. | |
| 2021/0381798 | A1 | 12/2021 | Witzigreuter | |
| 2023/0296349 | A1 | 9/2023 | St. Phillips | |

OTHER PUBLICATIONS

The PCT Search Report and Written Opinion mailed Sep. 18, 2023 for PCT Application No. PCT/US2023/014710, 9 pages.
Office Action for U.S. Appl. No. 17/696,632, mailed on Feb. 7, 2023, Eric A. St. Phillips, "Air Gun With Automatic Cocking", 10 pages.

* cited by examiner

*Primary Examiner* — Bret Hayes
(74) *Attorney, Agent, or Firm* — Lee & Hayes, P.C.

(57) ABSTRACT

An automatically cocking air gun includes a cocking mechanism including a compression tube, a compression piston, and a spring. An actuator assembly is coupled to the compression tube to selectively move the compression tube between a firing position and a cocking position. The actuator assembly includes a lead screw and a lead screw nut driving a carriage to move the compression tube.

20 Claims, 11 Drawing Sheets

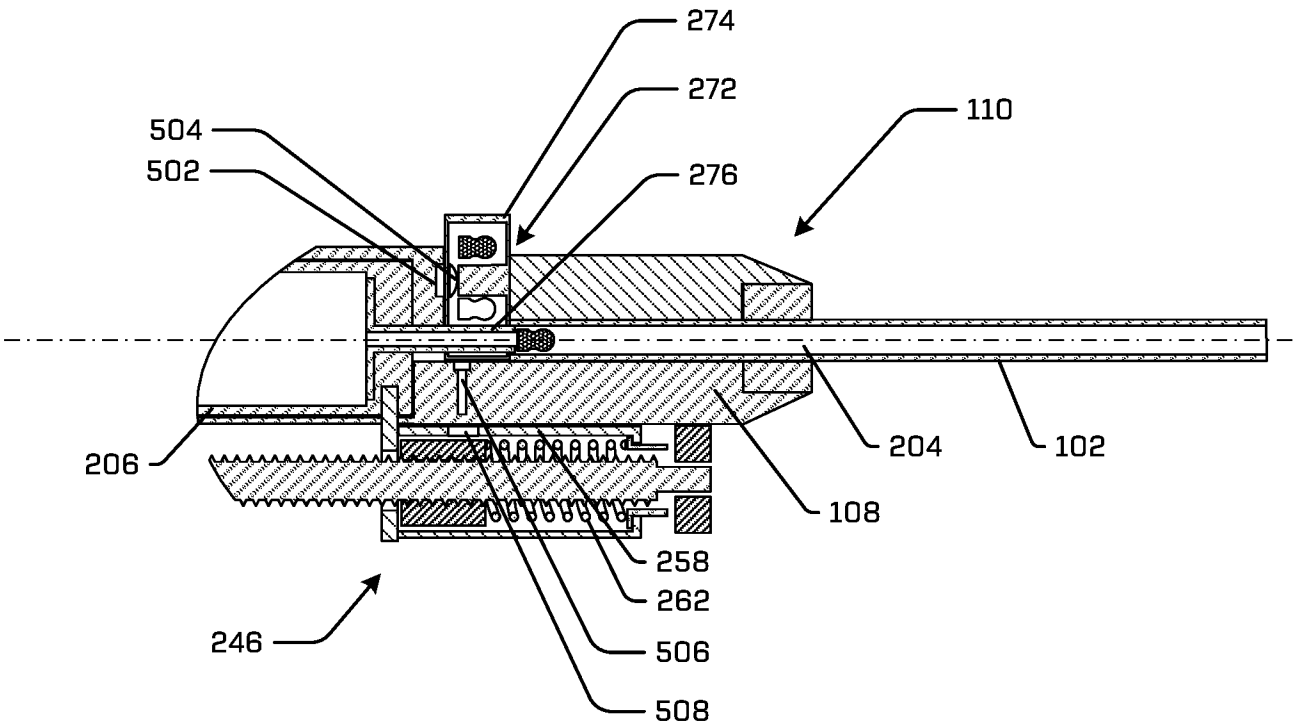
FIG. 5
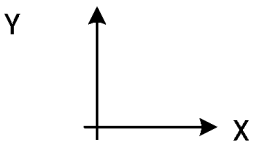

AIR GUN WITH AUTOMATIC COCKING

CROSS-REFERENCE TO RELATED APPLICATION

This application is a continuation of, and claims priority to, U.S. patent application Ser. No. 17/696,632, filed on Mar. 16, 2022, titled "AIR GUN WITH AUTOMATIC COCKING," which is incorporated in its entirety by reference.

BACKGROUND

Air guns are used for a variety of recreational purposes. Some types of air guns require manual interaction to ready the gun for firing. For instance, conventional break-barrel guns require a user to manually compress a spring by pivoting the barrel proximate the breach of the gun. Some pneumatic guns require a user to manually increase air pressure in a chamber, e.g., by pumping, or the like. These conventional designs can become fatiguing for some users and often are time consuming. There is a need in the art for an improved air gun that does not require conventional manual interaction.

BRIEF DESCRIPTION OF THE DRAWINGS

The detailed description is described with reference to the accompanying figures. In the figures, the left-most digit of a reference number identifies the figure in which the reference number first appears. The same reference numbers in different figures indicate similar or identical items.

FIG. 5 illustrates additional sensing modalities and components for detecting configurations and states associated with an air gun, according to example implementations of this disclosure.

DETAILED DESCRIPTION

Figure 1:
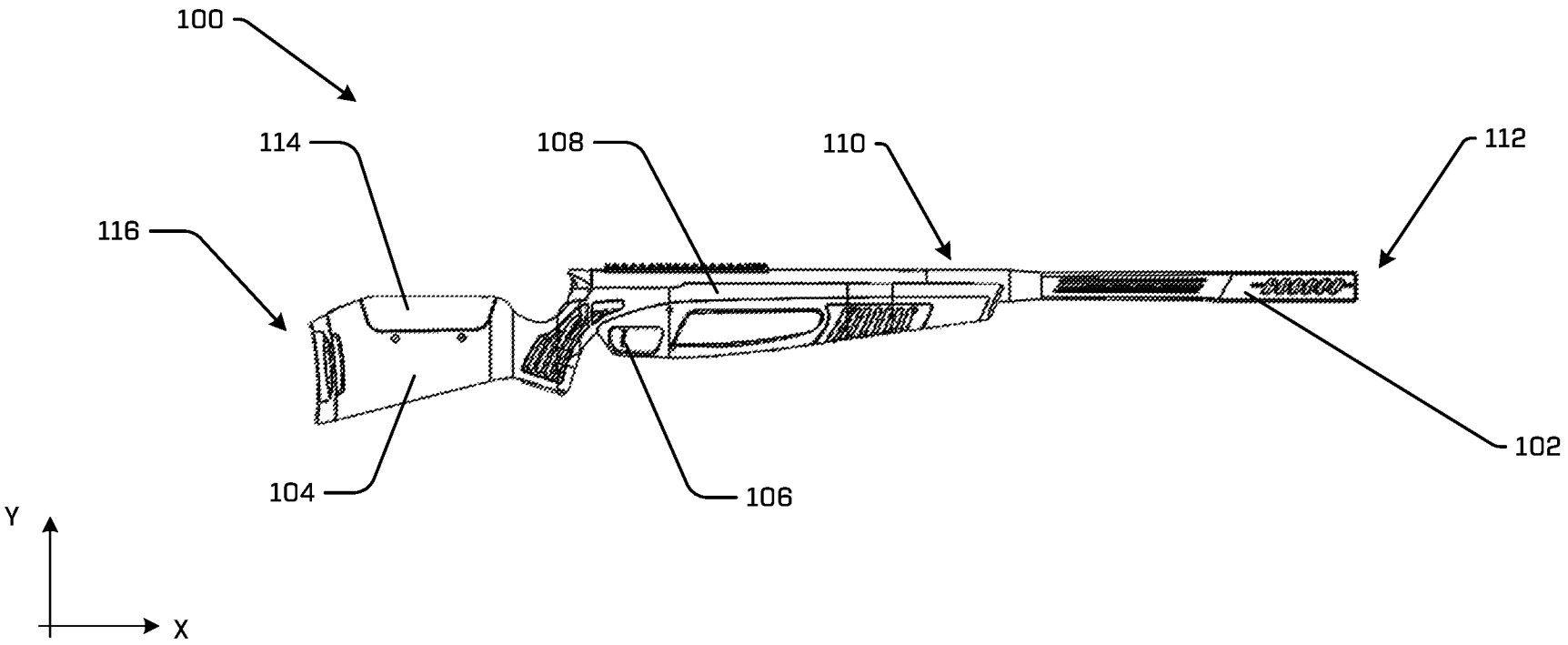
FIG. 1 is side view of an example air gun according to example implementations of this disclosure.

FIG. 1 illustrates an example spring piston air gun 100 according to aspects of this disclosure. More specifically, FIG. 1 is a side exterior view of one implementation of the air gun 100, which includes features for self- or automatic-cocking. FIG. 1 illustrates the air gun 100 as generally including a barrel 102, a stock 104, and a trigger 106. The air gun 100 also includes a housing 108 extending generally between the barrel 102 and the stock 104. The housing 108 may retain and/or conceal components of the air gun 100, as detailed further herein. Without limitation, aspects of this disclosure include components for self- or automatic-cocking of the air gun 100, which may be disposed in, attached to, or otherwise associated with the housing 108.

The barrel 102 extends generally from a breach end 110 to a muzzle end 112. Although not illustrated in FIG. 1, a bore extends through the barrel 102, from the breach end 110 to the muzzle end 112. The bore provides a hollow interior space within the barrel 102 through which compressed air and a projectile, such as a pellet, can pass, as will be described in greater detail below. The barrel 102 is sufficiently strong to contain high pressure gasses introduced into the barrel 102 to fire the projectile. In implementations, the bore may be smooth, or the bore may be rifled, e.g., to impart a stabilizing spin on the projectile as it passes through the bore.

The trigger 106 may be any lever, button, or the like, configured for user interaction to fire the air gun 100. As detailed further herein, in some instances the trigger 106 is a part of a trigger assembly that, among other features, prevents unintended firing of the air gun 100. For example, and without limitation, the trigger assembly may prevent firing of the air gun 100 while the air gun 100 is automatically cocking after firing a projectile.

The stock 104 may be any conventional size or shape. In some instances, the stock 104 may be removably secured to the housing 108, e.g. to promote removal and/or replacement of the stock 104. Moreover, and as discussed below, removal of the stock 104 may facilitate access to an interior of the housing 108, e.g., to service working components of the air gun 100. Although not illustrated in FIG. 1, a portion of the housing 108 may include rails extending generally longitudinally, and the stock 104 can be configured with receptacles that engage and slide along the rails. Without limitations, the housing 108 may be extruded and the rails may be a portion of the extrusion, although in other instances the rails may be separately manufactured and secured to the housing 108. In still further examples, the stock may include one or more rails that cooperate with one or more receptacles on the housing 108. The use of rails may reduce the number of fasteners required to secure the stock 104 to the housing 108 and/or may provide a more pleasing aesthetic.

In the example of FIG. 1, the stock 104 includes a removable portion 114. The removable portion 114 is removable to example a hollow compartment or receptacle in which components of the air gun 100 may be stored. For example, and without limitation, a power source (not shown) for powering components that promote automatic cocking of the air gun 100 may be retained in the stock 104. For example, the removable portion 114 may be removed to expose a battery compartment. Although the removable portion 114 is shown as a cheek portion of the stock 104, in other examples, the removable portion 114 can be formed at a butt end of the stock 104, e.g., as a portion of a recoil pad 116.

The housing 108 is generally provided to contain components of the air gun 100. For instance, and as detailed further below, the housing 108 may contain, support, and/or conceal aspects that facilitate automatic cocking and/or action of the air gun 100. The shape and size of the housing 108 in FIG. 1 is for illustration. Other shapes, sizes, and compositions are contemplated. Components of the housing may be made of any conventional materials, including but not limited to, metal, such as aluminum, or polymers. Additional details of the air gun 100 now will be discussed with reference to additional figures.

Figure 2:
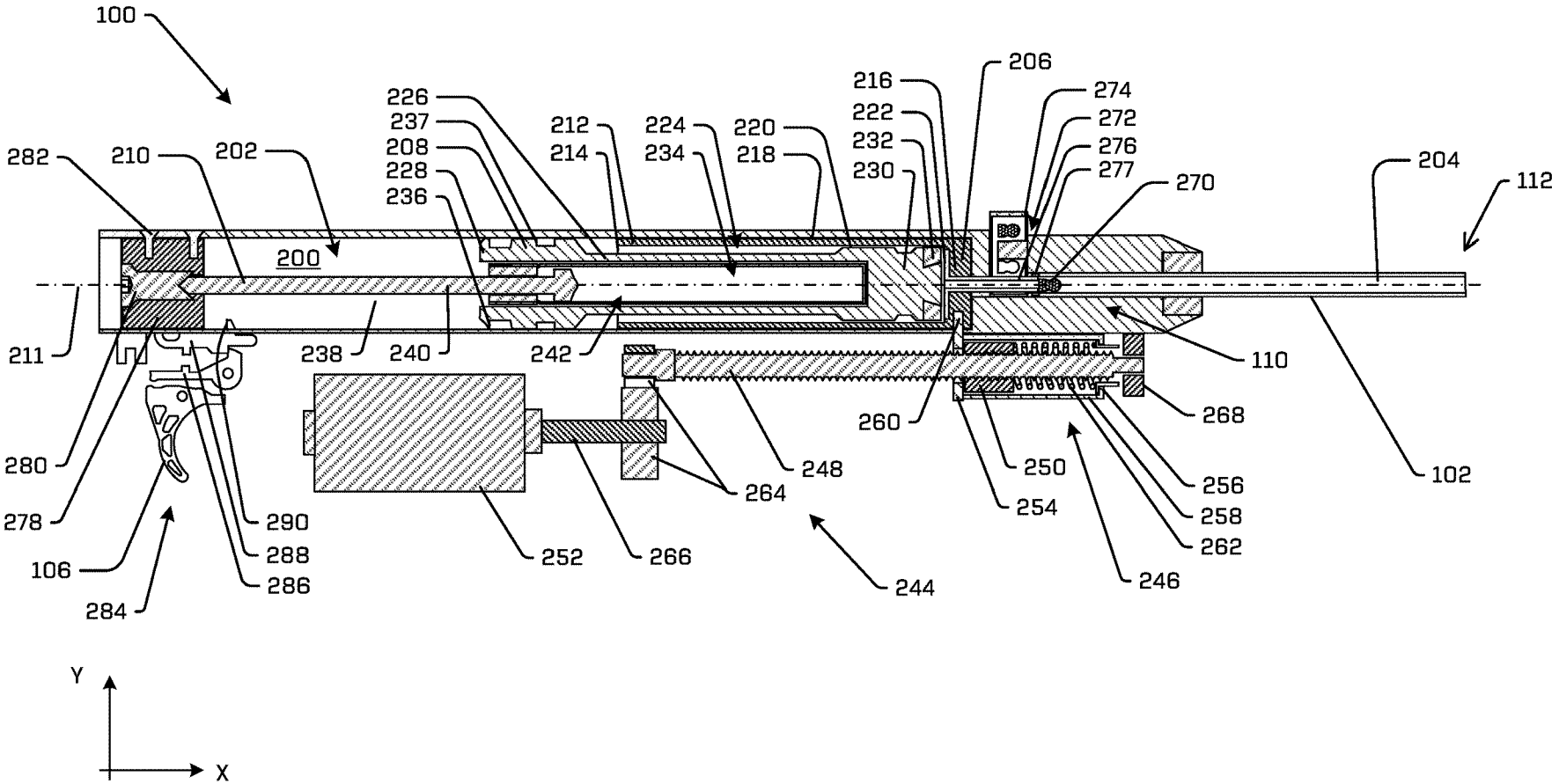
FIG. 2 is a cross-sectional view of portions of an air gun with automatic cocking, according to example embodiments of the present disclosure.

FIG. 2 is a cross-section of the air gun 100 taken generally in the X-Y plane of FIG. 1. In FIG. 2, the stock 104 and portions of the housing 108 are removed for clarity. As shown, the housing 108 of the air gun 100 includes a chamber wall 200 defining a chamber 202. As detailed herein, the chamber 202 retains, aligns, and/or otherwise supports a compression tube 206, a compression piston 208, and a spring 210 disposed in the chamber 202.

The compression tube 206 is of a type generally well known in the art. The compression tube 206 is disposed to slide in the chamber 202, e.g., generally along a longitudinal axis 211 of the air gun 100. The compression tube 206 generally includes a cylindrical sidewall 212 extending between an open end 214, closer to the stock along the longitudinal axis, and a closed end 216, closer to the barrel 102 along the longitudinal axis 211. The sidewall 212 includes an outer surface 218 separated from an inner surface 220 by a wall thickness. The outer surface 218 is disposed proximate the chamber wall 200. For example, the outer surface 218 is disposed to move relative to the chamber wall 200, e.g., via a lubricated guiding interface. The inner surface 220 of the sidewall 212, together with an inner face 222 of the closed end 216 generally define a compression tube volume 224. The compression tube 206 may be formed from any number of rigid materials, including but not limited to metal, for performance, safety and durability factors.

The compression piston 208 includes a sidewall 226 extending between an open end 228 and a closed end 230. The compression piston 208 is configured to slide, generally along the longitudinal axis 211, relative to the chamber wall 200 and the compression tube. As illustrated in FIG. 2, the closed end 230 of the compression piston 208 is sized to be received in the compression tube volume 224 and includes one or more seals 232 sealing the compression piston 208 relative to the inner surface 220 of the compression tube 206. Proximate the open end 228, the compression piston is configured to slide relative to the chamber wall 200. For example, the compression piston 208 may be sized proximate the open end 228 to contact the chamber wall 200. Although not illustrated in FIG. 2, one or more rings, e.g., guide rings, may be disposed to promote movement and alignment of an outer surface of the compression piston 208 proximate the open end 228, relative to the chamber wall 200. As also illustrated in FIG. 2, the piston defines an inner piston volume 234 generally accessible via the open end 228. The compression piston 208 also includes, proximate the open end 228, a searing surface 236. The piston searing surface 236 may take the form of an annular groove in the outer surface of the compression piston 208. For example, when the searing surface is formed, eliminating the need to control orientation of the compression piston 208 relative to the trigger 106. As detailed further herein, the piston searing surface 236 engages with the trigger 106 (or a member coupled to the trigger 106) to retain the compression piston 208 in a cocked position.

An outer surface of the sidewall 226 of the compression piston 208 is illustrated as being contoured in FIG. 2. The contour can include a plurality of protrusions 237, e.g., annular protrusions, formed as tail guides to create multiple points of contact with the compression tube 206 and/or the chamber wall 200. These points of contact maintain the compression piston 208 in a concentric orientation with the compression tube 206 to increase efficiency of the compression piston 208 and reduce noise upon movement of the compression piston from the cocked to the fired position.

In some examples, the protrusion 237 can be annular protrusions extending around the entire circumference of the compression piston 208. In other examples, the protrusions 237 may provide multiple points of contact about the circumference, e.g., three points of contact. These three points may be the minimum number of contacts required to keep the compression piston 208 concentric to the compression tube 206. The protrusions 237 can be located at a variety of circumferential positions, although it may be advantageous to symmetrically locate the protrusions about the 360-degree circumference of the piston body. Thus, each of the protrusions 237 may include three protrusions located at 120° intervals about the longitudinal axis 211. This arrangement may minimize the frictional losses associated with the protrusions, by reducing friction. The protrusions can be located anywhere on the circumference of the sidewall 226 and anywhere along the longitudinal dimension of the sidewall 226.

Although FIG. 2 illustrates the protrusions 237 on the sidewall 226 of the compression piston 208 as integrated into the sidewall 226 and generally rectangular in shape, in other implementations, the protrusions 237 may be generally spherical or hemispherical and/or may be separate members retained within corresponding recesses in the sidewall 226. In other examples, the protrusions 237 can include faceted, apex, line, or point contact surfaces. It is also understood the number of protrusions 237 can range from one to a multiple such as 10 or more, depending on the desired operating characteristics and design construction. In some examples, it may be desirable to have the protrusions embodied as separable pieces which may be made of plastic, for example. For instance, the protrusions be formed of a variety of materials, including but not limited to polymers such as nylon, Acetal (POM), PTFE and PTFE coated nylon or filled polymers with lubricants such as graphite, TFE or molybdenum. While numerous configurations of the protrusions 237 are non-metal, it is understood various alloys and metals, such as oil impregnated bronze can be used for the protrusions.

The spring 210 is in communication with the compression piston 208 and is configured to bias the compression piston 208 toward the barrel 102, e.g., along the longitudinal axis 211. In the embodiment of FIG. 2, the spring 210 is a gas spring having a gas spring body 238 and a gas spring piston 240. The gas spring body 238 is disposed in the inner piston volume 234 and defines a sealed interior chamber 242 containing a compressed gas. The gas spring piston 240 extends into and is moveable relative to the sealed interior chamber 242. As will be appreciated, as the gas spring piston 240 is forced into the sealed interior chamber 242 during cocking, e.g., as the gas spring body 238 is moved relatively away from the barrel 102 (toward the stock 104, not shown), the effective volume of the interior chamber 242 is reduced. The increased pressure creates a force on the compression piston 208, urging the compression piston 208 toward the barrel 102.

In FIG. 2 the spring 210 is embodied as a longitudinal gas spring. The spring 210 can be longitudinally compressed or extended, but returns to a former configuration when released. In some instances, the spring 210 may be a coil that expands and contracts generally along a longitudinal axis of the spring 210. The spring 210 can be any of a variety of configurations including metal coil or helical springs, composite or alloy coil or helical springs, as well as struts or gas spring. These and other springs are generally well known in the industry.

The air gun 100 further includes an actuator assembly 244. As detailed further herein, the actuator assembly 244 facilitates automatic cocking of the air gun 100, e.g., cocking without user intervention or user action. More specifically, the actuator assembly 244 is coupled to the compression tube 206, to selectively move the compression tube 206 between a firing position and a cocking position, as detailed further herein. As shown in FIG. 2, the actuator assembly 244 generally includes a carriage 246, a drive screw 248, a drive screw nut 250 threaded on the drive screw 248, and a rotary actuator 252.

The carriage 246 is coupled to the compression tube 206, such that movement of the carriage 246 in a direction parallel to the longitudinal axis causes a corresponding movement of the compression tube 206 in the chamber 202. The carriage 246 generally includes a first end 254 spaced longitudinally from a second end 256. In the illustrated example, the first end 254 and the second end 256 are embodied as plates, although other configurations may also be used. The carriage 246 may also include one or more sidewalls 258 extending between the first end 254 and the second end 256. As also illustrated in FIG. 2, the carriage 246 includes a protrusion 260 proximate the first end 254. The protrusion 260 may be a pin, bar, plate, or other feature that is received in a corresponding receptacle of the compression tube 206. Of course, this arrangement is for example only; any mechanical coupling that causes movement of the carriage 246 to move the compression tube 206 may be used. In at least one example, the carriage 246 may include a receptacle, and the compression tube 206 may include a protrusion received in the receptacle.

The carriage 246 is configured to move along the drive screw 248. More specifically, in the example of FIG. 2, the first end 254 and the second end 256 include openings extending therethrough that provide clearance for the drive screw 248. The drive screw 248 passes through the carriage 246. The drive screw nut 250 threadedly engages the drive screw 248. As shown, the carriage 246 is disposed such that the drive screw nut 250 is disposed (longitudinally) between the first end 254 and the second end 256. Also in the example, a spring 262 is disposed (longitudinally) between the drive screw nut 250 and the second end 256.

The rotary actuator 252 is disposed to drive the drive screw 248, e.g., by causing the drive screw 248 to rotate about its longitudinal axis. In the illustrated example, a plurality of gears 264 are provided between a shaft 266 of the rotary actuator 252 and the drive screw 248. The gears 264 may provide a decreased rotational velocity of the drive screw 248, e.g., relative to a rotational velocity of the shaft 266 thereby increasing the torque of drive screw 248. For example, the gears 264 may provide a gear ratio of from about 1:1.5 to about 1:20. Although only two gears are shown in FIG. 2, more gears may be included. In some instances, the gears 264 may be embodied in a gear box. The gears 264 are provided for example only; other components and systems for transferring power from the rotary actuator 252 to the drive screw 248 also are contemplated. Moreover, in some examples, the shaft 266 may be directly coupled to the drive screw 248, e.g., such that the shaft 266 and the drive screw 248 rotate about the same axis. As also shown in FIG. 2, an end of the drive screw 248 opposite the end coupled to the rotary actuator 252 is supported by a bearing 268, which may be a ball bearing, needle bearing, sleeve bearing or the like.

In operation, the actuator 252 drives the drive screw 248, causing the drive screw nut 250 to move in the longitudinal direction. For example, when the shaft 266 of the actuator 252 rotates in a first rotational direction, the drive screw nut 250 moves in a first longitudinal direction, and, when the shaft 266 rotates in a second rotational direction, opposite the first rotational direction, the drive screw nut 250 moves in a second longitudinal direction, opposite the first longitudinal direction. In the illustrated example, when the drive screw nut 250 moves in a direction generally away from the barrel 102 and toward the stock 104, the drive screw nut 250 contacts the first end 254 of the carriage 246, causing the carriage 246 to move in the same direction. Conversely, when the drive screw nut 250 moves in a direction generally toward the barrel 102 and away from the stock 104, the drive screw nut contacts the spring 262, which in turn contacts the second end 256 of the carriage 246. The spring 262 is sufficiently rigid that, absent some impediment to travel of the compression tube 206, the force applied by the drive screw nut 250 to the spring 262 is almost entirely transferred to the second end 256 of the carriage 246. The spring 262 may facilitate non-destructive overtravel of the drive screw nut 250, e.g., after the compression tube 206 has reached an advanced, firing position, as detailed further below.

In the illustrated example, the carriage 246 may be configured to travel relative to the housing 108 along rails incorporated into the housing. For example, the rails may extend generally parallel to the drive screw 248 and the carriage includes mating grooves that slide along the rails. This arrangement may act as a linear bearing system that also functions to resolve the torque moment forces resulting from the offset distance between an axis of the spring 210 and an axis of the lead screw 248. The bearing system can also resolve torque moment forces resulting from friction between the lead screw and lead screw nut transferred to the carriage. Although not illustrated in FIG. 2, the carriage 236 may also include an anti-rotation key that prevents (or significantly restricts) rotation of the lead screw nut 250 within the carriage sidewall 258, while allowing axial movement of the lead screw nut 250 against the over-travel spring 262.

The actuator assembly 244, the compression tube 206, the compression piston 208, and the spring 210 cooperate to selectively cock and fire projectiles from the air gun 100. In examples, projectiles, such as a projectile 270, are loaded into the air gun 100 proximate the breach end 110 of the barrel 102, via a magazine receptacle 272 formed as an opening in the housing 108. In the illustrated example, the magazine receptacle 272 is configured as an opening sized and shaped to receive a magazine 274 carrying one or more projectiles. In examples, the magazine 274 may be an automatically indexing magazine, including one or more projectile holding passages arranged in a circular pattern and rotatable about a central pivot, e.g., as in a carousel-type arrangement, to selectively present a single projectile for firing. More specifically, the magazine 274 may further include an entry port and an axially-aligned outlet port, which also are aligned with the bore 204. Although not illustrated in FIG. 2, seals, such as ring seals, may be provided on the magazine 274 and/or in the magazine receptacle 272 to limit or prevent compressed air from leaking at the interfaces associated with the magazine 274.

As also shown in FIG. 2, a hollow probe 276 extends from the closed end of the compression tube 206, in a longitudinal direction away from the compression tube 206. The hollow probe 276 provides a fluid passageway from the compression tube volume 224 of the compression tube 206 into the barrel bore 204 of the barrel 102, through which compressed air passes to fire the projectile 270. As detailed further below, the hollow probe 276 also passes at least partially through the magazine 274, to advance the projectile 270 out of the magazine 274, via the outlet port, and into the barrel 102 for firing. In the illustrated example, a seal 277, which may be an o-ring, a wiper seal, or the like, is disposed to create a seal between the hollow probe 276 and the barrel bore 204. Although illustrated as being secured to the barrel 102, the seal 277 may be fixed to a distal end of the hollow probe 276 in other examples. In still further examples, the seal 277 may be disposed in the magazine 274 and/or at a position on the left-side (in the image of FIG. 2) of the magazine 274, e.g., to seal the probe 276 relative to the housing 108. As will be appreciated, the seal 277 and/or other or additional sealing mechanisms may be disposed to facilitate compressed air forced through the probe 276 and into the barrel bore 204 exiting the air gun 100 only via the barrel 102.

Figure 7:
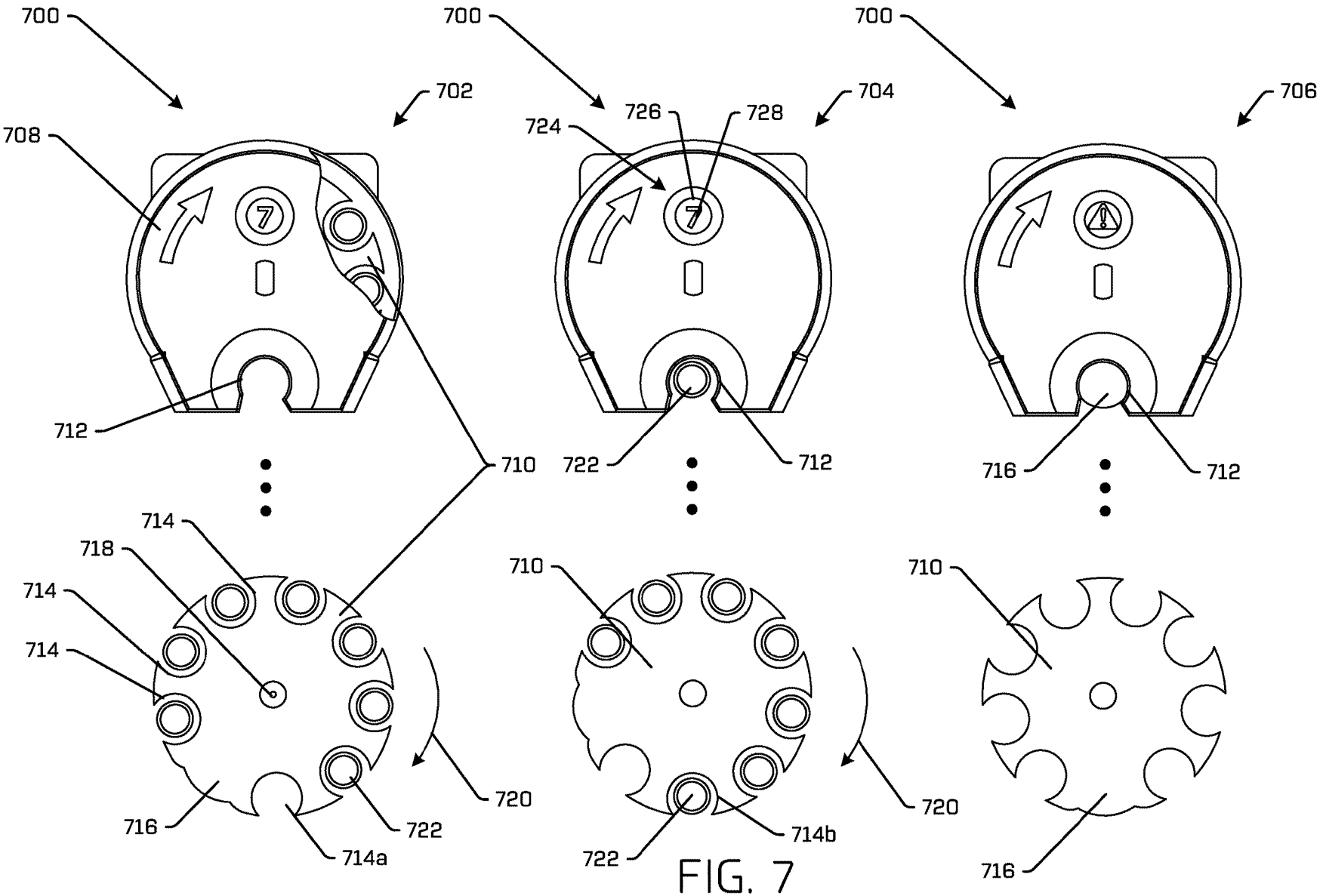
FIG. 7 illustrates example components of an indexing magazine for use with an air gun, according to examples of this disclosure.

As also shown in FIG. 2, a retention block 278 is disposed in a rear, e.g., relatively closer to the stock 104 (not shown), end of the chamber 202. The retention block 278 is generally provided to terminate the end of the chamber 202. Moreover, in the illustrated example, the retention block 278 defines a threaded opening for receiving a threaded plug 280. When received in the retention block 278, the threaded plug 280 may be adjusted (e.g., by threading) to contact the spring 210, e.g., to provide a desired loading to the spring 210. As also shown, the retention block 278 may be retained in the chamber 202 via one or more fasteners 282. The fasteners 282 are illustrated as two pan head screws in FIG. 2, although other fasteners may be used to secure the retention block 278. An example configuration including a retention block is illustrated in FIG. 7 and discussed in more detail, below.

FIG. 2 also illustrates the trigger 106 as part of a trigger assembly 284. In the illustrated example, the trigger assembly 284 includes a first linkage 286 and a sear 288. A trigger scaring surface 290 protrudes from the sear 288. As detailed further below in connection with FIGS. 3A-3C, the trigger searing surface 290 protrudes from the sear 288 and contacts the piston searing surface 236 to retain the air gun 100 in a cocked configuration. The trigger 106, the first linkage 286, and the sear 288 cooperate via a number of surfaces, protrusions, recesses, and the like, such that movement of the trigger 106 results in movement of the first linkage 286 and the sear 288, e.g., to fire the air gun 100 by releasing the piston searing surface 236, and/or such that movement of the sear 288 results in movement of the first linkage 286 and the trigger 106, e.g., to cock the air gun 100 by engaging the trigger searing surface 290 with the piston searing surface 236. Although the trigger assembly 284 is illustrated as including three components, this disclosure is not limited to the illustrated configuration. For instance, the trigger assembly 284 can include as few as a single component, e.g., the trigger 106, or more components. Generally, the trigger assembly 284 functions to retain the air gun 100 in a cocked configuration (discussed further below) and/or to fire the air gun 100 in response to a user squeezing the trigger 106.

Figure 3A:
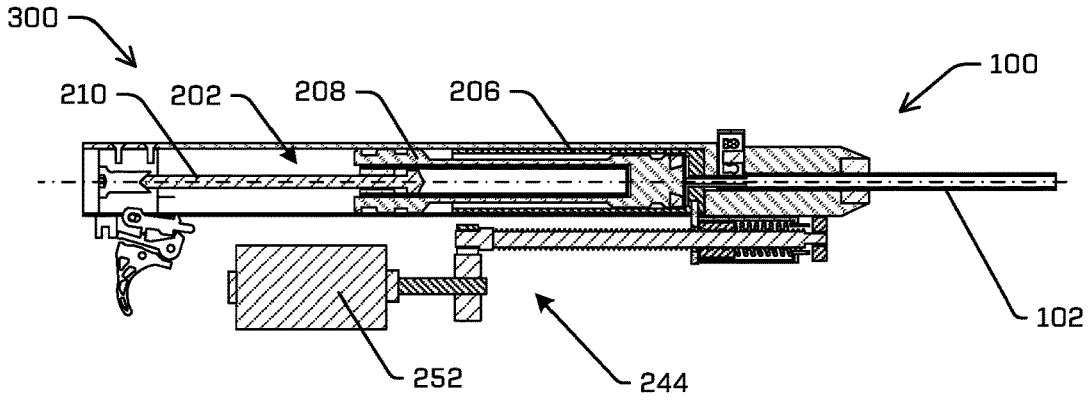
FIGS. 3A-3C illustrates the air gun of FIG. 2 in various configurations, according to example embodiments of this disclosure.
Figure 3B:
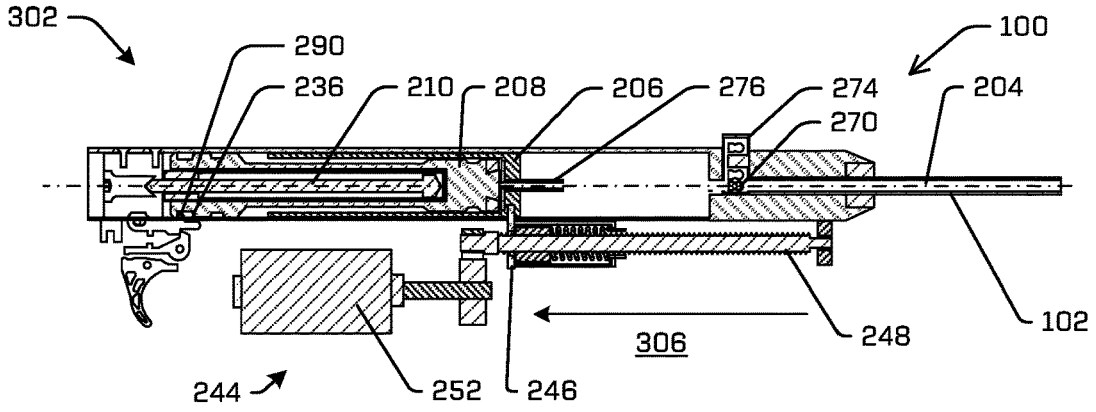
Figure 3C:
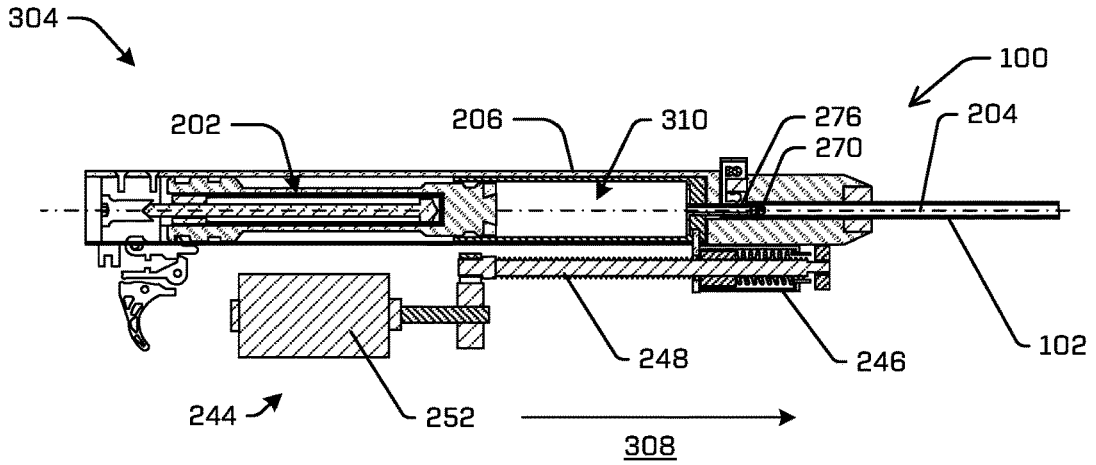

The air gun 100 illustrated in FIG. 2, and just described, is configured for automatic or automated cocking. More specifically, the actuator assembly 244 facilitates automatic cocking of the air gun 100 by selectively moving the compression tube 206 via the carriage 246. FIGS. 3A-3C illustrate aspects of this automatic cocking. Specifically, FIG. 3A-3C are cross-sectional views of the air gun 100 in three different configurations, including a fired configuration 300, a cocking configuration 302, and a firing configuration 304, each of which is described in turn below.

FIG. 3A shows the air gun 100 in the fired configuration 300, in which the air gun 100 has just been fired. In the fired position 300, the compression tube 206 is in an advanced, firing position, in which the hollow probe 276 extends through the magazine 272. Also in the fired configuration 300, the compression piston 208 is in an advanced, fired position, in which the compression piston 208 is generally disposed in the compression tube 206 and the spring 210 is in an extended position. The fired configuration 300 may correspond to a normal, or un-cocked, state of the air gun 100, in which the spring 210 is not compressed.

Figure 4A:
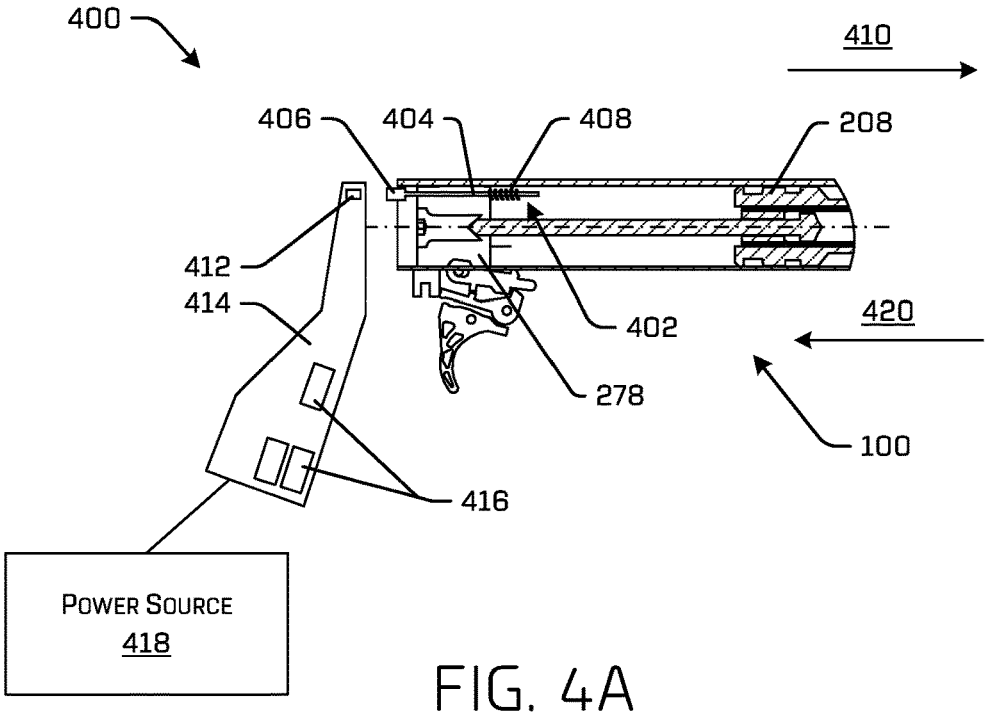
FIGS. 4A and 4B illustrate aspects of sensing a position of an air gun, according to example embodiments of this disclosure.
Figure 4B:
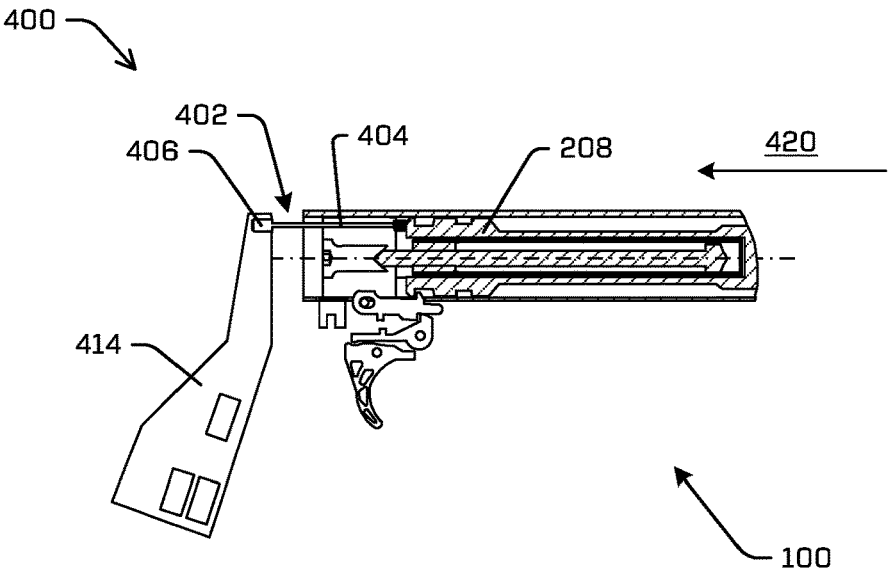

After firing, the actuator assembly 244 (automatically) causes the air gun to advance to the cocking configuration 302, shown in FIG. 3B. More specifically, the actuator 252 imparts a rotational motion on the drive screw 248 that causes the drive screw nut 250 to move in a first linear direction 306 generally toward the stock (not shown) and away from the barrel 102. As the drive screw nut 250 is driven in the first linear direction 306, the drive screw nut 250 imparts a force on the first end 254 of the carriage 246 that causes the carriage 246 also to move in the first linear direction 306. As the carriage 246 is coupled to the compression tube 206, the compression tube also moves in the first linear direction 306. In turn, the compression tube 206 drives the compression piston 208 in the first linear direction 306, which causes the spring 210 to compress. Specifically, the movement of the compression tube 206 via the carriage 246 has sufficient force to overcome the force of the spring 210. Continued movement of the carriage 246 by the actuator 252 causes the compression tube 206 to advance to a compression tube cocking position, shown in FIG. 3B, and which may correspond to a cocked position of the compression piston 208. One or more sensors (examples of which are shown in FIGS. 4A and 4B, discussed below) may be provided to generate information that confirms that the compression piston 208 is in the cocked position. Such information may also be used to control the actuator 252 to stop continued actuation to drive the drive screw nut 250 in the first linear direction 306 and/or to impart an opposite rotational force on the drive screw 248.

As shown in FIG. 3B, in the cocking configuration 302, the piston searing surface 236 of the compression piston 208 engages with the trigger searing surface 290, to place the compression piston 208 in a cocked position, with the spring 210 in a fully compressed position. As also illustrated in FIG. 3B, with the hollow probe 276 retracted from the magazine 274, the magazine 274 automatically indexes to present the projectile 270 in line with the bore 204. As noted above, the magazine 274 may be automatically indexing, such that retraction of the hollow probe 276 causes the projectile 270 to automatically advance into the position shown in FIG. 3B. Alternatively, in embodiments the magazine 274 may be adapted to receive power, mechanical energy, and/or control signals from the air gun 100 that may control the indexing of the projectile 270.

With the compression piston 208 in the cocked position, the actuator assembly 244 causes the air gun 100 to advance to the firing configuration 304, shown in FIG. 3C. Advancement to the firing configuration 304 of FIG. 3C may occur automatically in some embodiments, e.g., after firing the air gun 100. In other embodiments, advancement to the firing configuration 304 may be at least partially manual. For instance, advancement to the firing configuration 304 may be initiated by a user. In some examples, a sensor, switch, or similar user interface element (not shown) may be provided that is configured to receive a user input, e.g., based on proximity, contact, or the like, of the user. The element (or a component associated with the element) may generate a signal that causes a controller in the air gun 100 to determine that the user desires to configure the air gun 100 in the firing configuration 304, and the controller may cause the air gun 100 to be configured in the firing configuration 304.

The transition to the firing configuration 304 may be implemented by the actuator 252 imparting a rotational motion on the drive screw 248 that causes the drive screw nut 250 to move in a second linear direction 308 opposite the first linear direction 306. As the drive screw nut 250 is driven in the second linear direction 308, the drive screw nut 250 imparts a force on the spring 264, which in turn imparts a force on the second end 256 of the carriage 246, causing the carriage 246 to move in the second linear direction 308. As the carriage 246 is coupled to the compression tube 206, the compression tube 206 also moves in the second linear direction 308, returning the compression tube 206 to a firing position, as in FIG. 3A. Unlike FIG. 3A, however, in the firing configuration 304 of FIG. 3C the compression piston 208 remains in the cocked position, via engagement of the trigger searing surface 290 with the piston searing surface 236. As also shown in FIG. 3C, as the compression tube 206 moves to the firing position, the hollow probe 276 contacts and advances the projectile 270 into the bore 204 for firing. In the firing configuration 304 of FIG. 3C, because the compression piston 208 remains in the cocked position, the compression piston 208 is spaced from the inner surface 222 of the closed end 216 of the compression tube 206, thereby creating a volume 310.

With the air gun 100 in the firing configuration 304, the air gun 100 is ready for firing. Specifically, pulling the trigger 106 will cause the trigger searing surface 290 to disengage from the piston searing surface 236, thereby allowing the spring 210 to extend, driving the compression piston 208 in the second linear direction 308. The movement of the compression piston 208 in this manner forces air in the volume 310 through the hollow probe 276 and out the bore 204, firing the projectile 270. The air gun is then returned to the fired configuration 300 of FIG. 3A.

As will be appreciated from the foregoing, the actuator assembly 244 controls the drive screw 248 to ready the air gun 100 for firing. Because the actuator assembly 244 cocks the air gun 100, the user need not perform actions normally associated with conventional spring guns, such as barrel breaking, pumping, or the like. Such manual labor between every shot can be fatiguing and time consuming. Additionally, the automatic cocking techniques described herein may allow a user to continue to effectively aim the air gun 100 at a target during cocking, which may not be possible with conventional guns.

The actuator assembly may automatically cycle from the fired configuration 300 to the cocking configuration 302 and then to the firing configuration 306, e.g., upon the projectile 270 being fired. In other examples, the air gun 100 may be provided with a user interface, e.g., one or more buttons, levers, switches, or the like, that allow the user to control the automatic cocking. For example, a user may interact with the user interface to cause the air gun 100 to cycle through the configurations shown in FIGS. 3A and 3C. In some examples, the actuator 252 and the gears 264 may provide rapid movement of the drive screw 248 and the drive screw nut 250. For example, and without limitation, the drive screw nut 250 may move at a rate of about 3 in/sec or 0.07 m/s in the first linear direction 206 and/or the second linear direction 208. In at least one example, the drive screw nut 250 may advance from the fired configuration 300 to cock the gun in the cocking configuration 302, and back to the firing configuration 306, a distance of about 8 inches, in about three seconds.

In some examples, the air gun 100 includes a number of sensing components to facilitate automatic cocking as described herein. Generally, the air gun 100 can include one or more sensors or components to determine when the air gun 100 is in the fired configuration 300, the cocking configuration 302, or the firing configuration 304. The air gun 100 can also include one or more sensors or components to determine that the compression tube 206 is in the firing position and/or the cocking position, that the compression piston 208 is in the fired position and/or the cocked position, and/or that the spring 210 is in the compressed and/or extended position. Examples of sensing components will be described now with reference to FIGS. 4A, 4B, and 5.

FIG. 4A is a partial cross-sectional diagram of a rear portion 400 (e.g., proximate the stock—not shown) of the air gun 100. The rear portion 400 includes features additional to those discussed above, including features for determining that the compression piston 208 of the air gun 100 is in the cocked position. In some implementations, the components shown in FIGS. 4A and 4B may be optional. Elements introduced previously are given the same reference numeral in FIGS. 4A and 4B.

In more detail, FIG. 4A illustrates a probe 402 extending through the retention block 278, generally in a longitudinal direction. Specifically, the probe 402 includes a body 404 extending through the retention block 278 and a head 406 on a side of the retention block 278 nearer the stock (not shown). For instance, the retention block 278 may have an aperture or sleeve formed therethrough that provides a clearance fit for the body 404 of the probe 402, but through which the head 406 cannot pass. In the illustrated example, the body 404 and the head 406 are generally cylindrical, although such is not required. Other shapes and profiles are anticipated and could function similarly. As also illustrated in FIG. 4A, a spring 408 biases the probe 402 away from the sensor 406, e.g., generally in a direction 410. As noted above, the head 406 cannot pass through the retention block 278. Accordingly, the probe 402 will generally maintain the illustrated position of FIG. 4A when the air gun 100 is not cocked. For instance, FIG. 4A corresponds to the air gun 100 being in the fired configuration 300 of FIG. 3A.

FIG. 4A also includes a schematic representation of a sensor 412 arranged proximate the head 406 of the probe 402. As discussed below, the sensor 412 is disposed to detect a presence/absence of the head 406 of the probe 402. Although disposed to sense the head 406 of the probe 402 in the example of FIG. 4A, the sensor 412 may sense other aspects of the probe 402 and/or other components. The sensor 412 may be a conventional sensor, including but not limited to an optical sensor, a mechanical sensor, an electromagnetic sensors, such as a hall-effect sensor, a pressure sensor, a vibration sensor, a strain sensor, an orientation sensor or any other sensor that can be used to detect conditions and provide signals from which the proximity of the head 406 (or other portions) of the probe 402 can be determined. The sensor 412 may also be otherwise positioned and/or other or additional sensors may be provided, e.g., to detect other positions or a range of positions corresponding to the cocked position. For example, an alternative arrangement may include a sensor and/or other mechanism that detects that the compression piston 208 is located in a position corresponding to the cocking position. In examples, the sensor 412 may make a binary determination (present/absent) of whether the probe 402 is sensed.

In the example, the sensor 412 is disposed on a circuit board 414, also shown schematically. The circuit board 414 may be sized and shaped for retention in the housing 108 and/or the stock 104 in some examples. The circuit board 414 is also illustrated as supporting additional electronic components 416. Without limitation, the additional electronic components 416 can include power sources, resistors, memory, integrated circuits, systems on a chip, microprocessors, microcontrollers, a field-programmable gate array (FPGA), a programmable logic device (PLD), programmable analog logic (PAL), an application specific circuit (ASIC), or other digital control system, as well as hardwired electronic control systems, or the like.

The circuit board 414 hardware can form a logic control unit, which receives inputs signal from the various sensors associated with the air gun 100 and sends control signals to other components of the air gun 100, including but not limited to the actuator 252. In embodiments, such a logic control unit can execute instructions stored in memory and can, for example and without limitation, include a microprocessor incorporating suitable look-up tables and/or control software executable by the microprocessor to cause the air gun 100 to operate according the control software stored in the memory, and based at least in part on data from sensors, as described herein.

Figure 8:
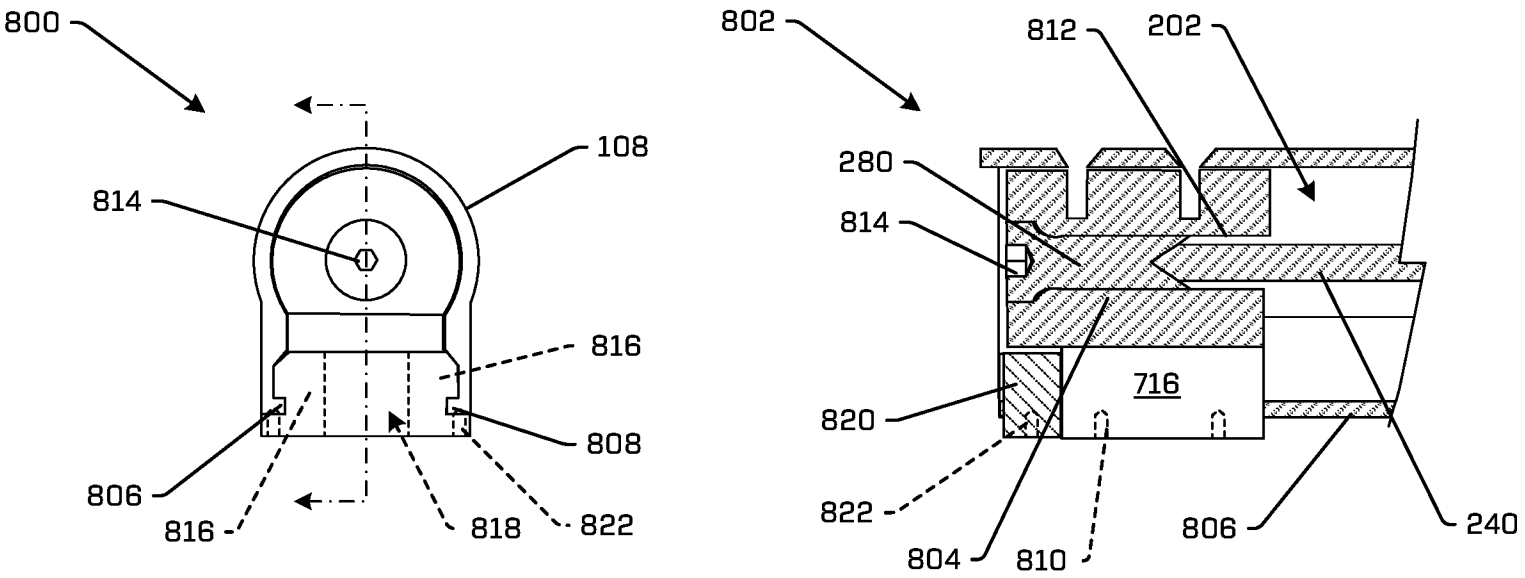
FIG. 8 includes end- and cross-sectional views showing aspects of an air gun, according to examples of this disclosure.
Figure 9:
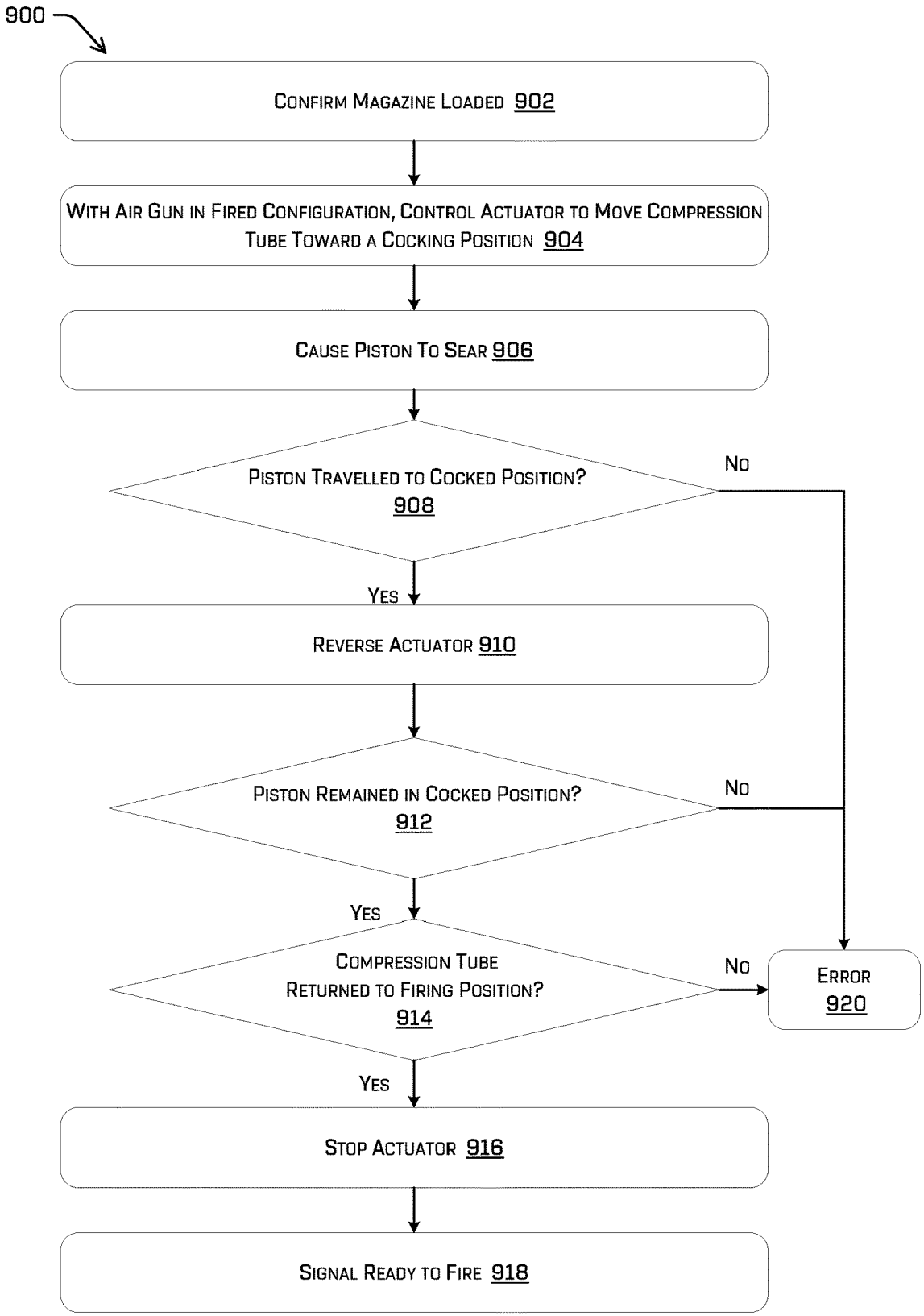
FIG. 9 is a flow chart showing operation of an automatically cocking air gun, according to examples of this disclosure.

In examples, the electronic components 416 may control aspects of the air gun 100. Without limitation, the circuit board 414 and/or the electronic components 416 can be configured to function as a controller associated with the air gun 100 to perform one or more of: receiving data, e.g., from the sensor 412 and/or other sensors associated with the air gun (as detailed further herein), controlling aspects of the actuator assembly, e.g., to automatically cock the air gun as detailed herein, controlling aspects of one or more user interface elements, e.g., to indicate to the user that the air gun 100 is ready for firing, is cocking, and/or needs maintenance, and/or logic and/or control operations. FIGS. 8 and 9, discussed further below, illustrate examples of control processes that may be implemented by the electronic components 416 and/or the circuit board 414.

In some examples, the circuit board 414 may include or be coupled to a port to which external devices may physically connected or a wireless communication system enabling external devices to be connected to the circuit board 414 using contactless communication technologies including but not limited to radio frequency communications such as Wi-Fi, Bluetooth, or near field communications, as well as optical communications including, but not limited to, infrared communications. Such communications can be used to improve or adjust programming, to examine stored information in the air gun 100, such as fault determinations, shot counts, and/or any other information related to operation and/or status of the air gun 100. For instance, such memory may be stored in a memory coupled to the circuit board 414.

Although described herein as a circuit board 414, it is not essential that the components be mounted to a single substrate. For example, and without limitation, various components of the circuit board 414 may be distributed within the air gun 100 to meet functional, simplicity, aesthetic, or other objectives with respect to the air gun 100.

In the example of FIG. 4A, the circuit board 414 is connected to a power source 418. The power source 418 may be a battery. For example, the battery may be stored in a compartment in the stock (not shown) of the air gun 100 and may be electrically connected to the circuit board 414, e.g., via one or more cables, leads, or the like. In other examples, the power source 418 may be an external power source, e.g., a battery pack, a cord, or the like. In some examples, the power source 418 may be selectively attached to the air gun 100, e.g., to charge a battery on the air gun 100, which may be one of the electronic components 416.

As noted above, in the example of FIG. 4A the air gun 100 is in the fired configuration 300 previously shown in FIG. 3A. In this example, the head 406 of the probe 402 is spaced from the sensor 412, such that the sensor 412 does not detect the head 406 of the probe 402. However, as the air gun 100 is cocked the compression piston 208 is moved toward the cocked configuration shown in FIG. 4B. This brings the compression piston 208 into contact with the probe 402, causing the probe 402 to move in a direction 420, opposite the direction 410. This arrangement is illustrated in FIG. 4B. Specifically, the force associated with moving the compression tube 206 into the cocking position, and thus the compression piston 208 into the cocked position, overcomes the spring force of the spring 408, and the head 406 of the probe 402 is advanced to a position in closer proximity to the sensor 412, such that the sensor 412 detects the probe 402.

The portion of the air gun 100 illustrated in FIG. 4B may generally remain the same when the air gun 100 is in the cocking configuration 302 discussed above in connection with FIG. 3B and/or the firing configuration 304 discussed above in connection with FIG. 3C. Specifically, whenever the compression piston 208 is in the cocked position, the sensor 412 will detect the probe 402, confirming the spring 210 is compressed. Conversely, when the probe 402 is not detected by the sensor 412, the air gun 100 is not cocked, and thus cannot be fired.

In some examples, the circuit board 414 may be connected to a light or other multi-state visible signaling device indicating the state of the air gun 100. For example, a first light color may indicate that the air gun 100 is cocked and a second light color may indicate that the air gun 100 is not cocked. Alternatively, a portion of the probe 402 may be visible from outside of the air gun 100, and adapted to provide a visible indicia that the air gun 100 is cocked (or not cocked). Without limitation, the probe 402 may have a portion that has one color that is visible through a portal or window in the housing 108 when the air gun 100 is in the cocked configuration and a second color that is visible when the air gun 100 is not cocked. Other visible indicia, such as symbols, text, and/or the like may also or alternatively be used.

The probe 402 and the sensor 412 may be arranged such that the probe 402 is sensed prior to the compression piston 208 contacting the retention block 278, e.g., during cocking. In this manner, a "presence" signal generated by the sensor 412 can be transmitted to the circuit board 414 to stop continued movement of the actuator in time to avoid a collision of the compression piston 208 with the retention block 278. Stated differently, the configuration of the probe 404 and the sensor 412 allow for some overtravel of the compression piston 208. Similarly, the trigger searing surface 290 and the piston searing surface 236 may be positioned to sear the compression piston 208 at a position spaced longitudinally from the retention block 278, and/or the piston searing surface 236 may be oversized in the longitudinal direction to accommodate such overtravel without the trigger searing surface 290 becoming dislodged from the piston searing surface 236.

FIG. 5 illustrates additional sensor modalities and functionality. Specifically, FIG. 5 is a partial cross-sectional view of aspects of the air gun 100 proximate the breach end 110 of the barrel 102.

As illustrated in FIG. 5, the air gun 100 includes a magazine sensor 502 proximate the receptacle 272 in the housing 108 configured to receive the magazine 274. The magazine sensor 502 is illustrated schematically and generally functions to confirm a presence/absence of the magazine 274. The sensor 502 may be disposed on a circuit board (not shown) or may be mounted to or otherwise supported by the housing 108. In the example of FIG. 5, the magazine 274 includes a magnet 504 integrated therein. The magnet 504 is detectable by the sensor 502. Specifically, the sensor 502 confirms presence of the magazine 274 when the magnet 504 is sensed and detects an absence of the magazine 274 when the magnet 504 is not sensed. In some examples, the magnet 504 may be overmolded during production of the magazine 274, e.g., such that some or all of the magnet 504 is embedded in a body of the magazine. In other instances, the magnet may be coupled to the magazine 274, e.g., via an adhesive, a press fit, mechanical means, or otherwise. Although the sensor 502 and the magnet 504 are used in the example of FIG. 5, other features for detecting presence/absence of the magazine 274 also are contemplated and include, but are not limited to, mechanical switches, optical sensors, or the like. For example, the magnet 504 may not be required in some alternate sensing configurations.

The magazine sensor 502 may be in communication with a controller associated with the air gun 100, which may be embodied as the electronic components 416. For example, the controller may prohibit movement of the actuator assembly 244 (not shown in FIG. 5), e.g., to prevent cocking of the air gun 100, absent an indication from the sensor 502 that the magazine 274 is loaded.

FIG. 5 also includes a schematic representation of a carriage sensor 506 coupled to the housing 108, e.g., below the bore 204. The carriage sensor 506 is disposed to sense a presence/absence of the carriage 246. The carriage sensor 506 may be disposed on a circuit board (not shown) or may be mounted to or otherwise supported by the housing 108. In at least some examples, the magazine sensor 502 and the carriage sensor 506 may be disposed on, or in communication with, the same circuit board.

In the illustrated example, a magnet 508 is secured to the sidewall 258 of the carriage 246. The magnet 508 is illustrated schematically and is disposed to be sensed by the carriage sensor 506 when the carriage 242 is in a predetermined, e.g., front-most in FIG. 5, position. For example, in FIG. 5, the air gun 100 is illustrated in the firing configuration 304 corresponding to FIG. 3C, in which the air gun is cocked, and ready for firing. In the example of FIG. 5, the carriage senor 506 detects the magnet 508 only when the carriage is in the illustrated position. When the carriage is anywhere other than the position shown in FIG. 5, the carriage sensor 506 indicates an absence of the magnet 508.

The carriage sensor 506 may be in communication with a controller associated with the air gun 100, which may be embodied as the electronic components 416. For example, the controller may require a signal from the carriage sensor 506 confirming the presence of the magnet 508 before configuring the air gun 100 for firing. For instance, the user may be prevented from firing the air gun 100, e.g., via an electronic trigger lock, switch, or the like, until the carriage 246 is confirmed to have returned to the illustrated position. As will be appreciated, in the firing configuration illustrated, the hollow probe 276 is in position to transmit compressed air from the compression tube 206 into the bore 204 of the barrel 102. Firing the air gun 100 with the carriage 246 (and thus the compression tube 206) in a position rearward (relatively closer to the stock) of the firing position may cause compressed air to be released into a volume between the compression tube 206 and the bore 204, which may cause jamming, damage, and/or other problems. Moreover, failure of the carriage to reach the position illustrated in FIG. 5 may indicate a malfunction, such as two projectiles in the bore 204, which could result from and/or lead to jamming of the air gun 100.

In addition to sensing the position of the compression tube 206 for safe firing of the air gun 100, data from the sensor 506 can also be used to stop travel of the carriage 246, e.g., by stopping the actuator 252. In examples, the compression tube 206 may come to rest upon contacting the end of the chamber 202, even with continued rotation of the drive screw 248. As will be appreciated, in the illustrated arrangement, the drive screw nut 250 can continue to travel without causing the carriage 246 to move further. Also in the arrangement, the spring 262 can provide resistance to this "overtravel." In some examples, the resistance provided by the spring can be detected, e.g., via an increased current load, and used to signal the actuator 252 to stop. That is, in some contemplated examples the sensor 506 can be used to detect a presence of the carriage 246 and other sensor modalities may be used to control the actuator 252.

The carriage sensor 506 and the magnet 508 are one example for detecting presence/absence of the carriage in the illustrated position of FIG. 5. Other features for detecting presence/absence of the carriage 246 also are contemplated and include, but are not limited to, mechanical switches, optical sensors, or the like. Moreover, although the magnet 508 is shown as integrated in the sidewall 258 of the carriage 246, in other examples, the magnet 508 may be disposed on other portions of the carriage, including but not limited to the first end 254 or the rear end 256 of the carriage 246. In further examples, the magnet 508 may be secured to the drive screw nut 250, although the potential for overtravel, as discussed above, may make this arrangement less desirable in some instances.

As just described, FIG. 5 includes the carriage sensor 506 to verify that the carriage 246, and thus the compression tube 208, is in position for firing. The carriage sensor 506 may prevent firing of the air gun 100 prior to completion of the cocking cycle. The air gun 100 may also include additional sensors and/or enable sensing techniques for determining a status of the air gun 100. Without limitation, in some examples, the actuator 252 may, in some examples, include an encoder or resolver. The encoder/resolver may provide velocity and/or positional feedback to a controller associated with the air gun 100. Such feedback may simplify controlling the compression chamber position and could augment or replace other monitoring, sensor-based and/or timer-based functions.

The air gun 100 may also include additional features to prevent inadvertent firing. Specifically, FIGS. 6A and 6B are used to illustrate a mechanical trigger lock for preventing inadvertent discharge when the compression tube 206 is not in the proper position for firing.

Figure 6A:
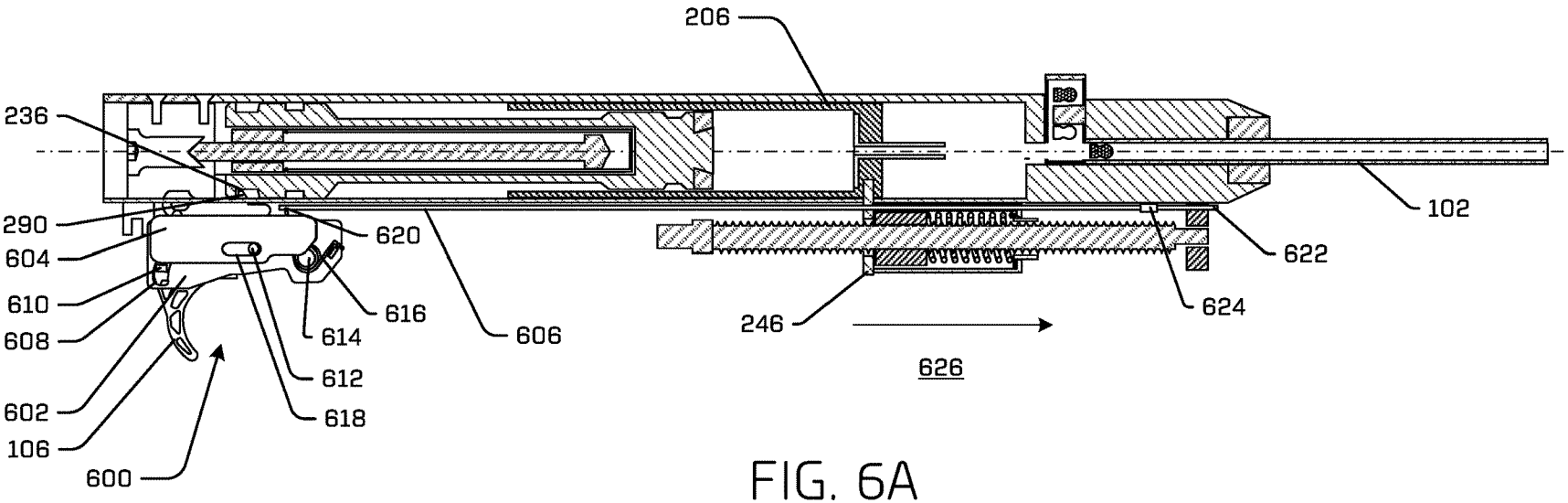
FIGS. 6A and 6B illustrate example components associated with a trigger lock assembly for an air gun, according to examples of this disclosure.
Figure 6B:
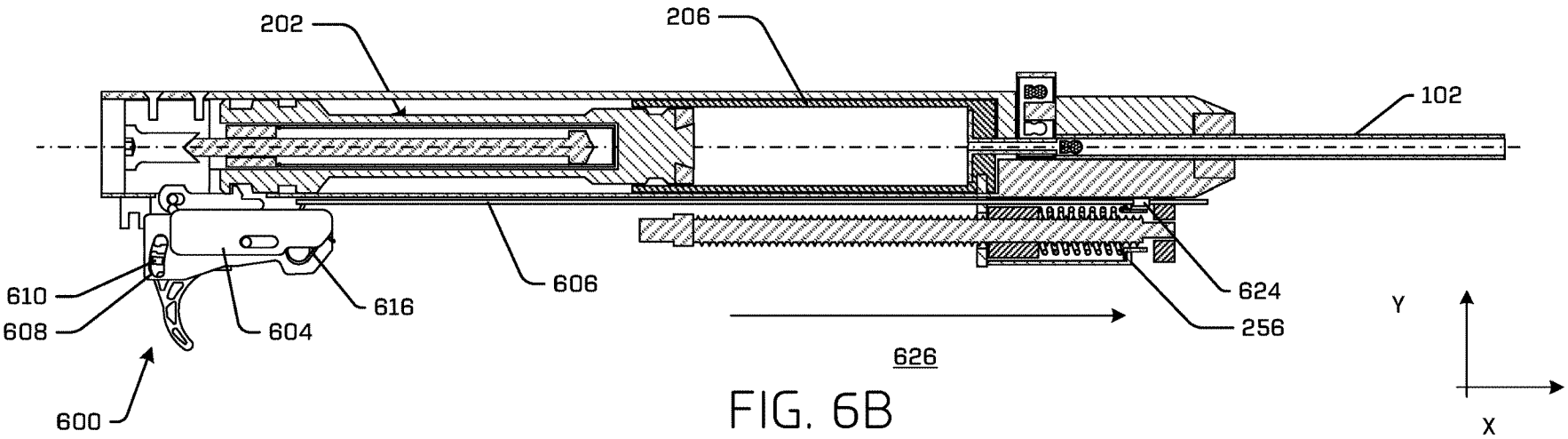

FIG. 6A is a cross-sectional view of the air gun 100 showing aspects of an optional trigger lock assembly 600. In FIGS. 6A and 6B, some components (like the actuator 252) have been removed for clarity. The trigger lock assembly 600 generally prevents inadvertent firing of the air gun 100 when the carriage is other than in the forward-most or firing configuration. As shown, the trigger lock assembly 600 includes a mounting plate 602, a locking plate 604, and a rod 606 coupled to the locking plate 604 as detailed further herein.

The mounting plate 602 is generally fixed relative to the air gun 100. The mounting plate 602 includes a slotted opening 608 sized to provide a clearance fit for a trigger protrusion 610 that extends laterally (e.g., normal to the X-Y plane of FIG. 6A) from the trigger 106. The slotted opening 608 is generally arcuate, although other shapes and sizes will be appreciated with the benefit of this disclosure. The mounting plate 602 also includes a post 612 protruding laterally (e.g., normal to the X-Y plane of FIG. 6A) therefrom. The mounting plate 602 also includes mounting features 614 for securing a spring 616 to the mounting plate 602.

The locking plate 604 includes a slot 618 configured to receive the post 612 of the mounting plate 602 therein. As detailed further below, the locking plate is movable relative to the mounting plate 602 via movement of the slot 618 about the post 612. Although obscured by the perspective of FIG. 6A, the spring 616 is coupled to the locking plate 604. The spring 616 is arranged to bias the locking plate 604 into a locking position illustrated in FIG. 6A. In the locking position, the locking plate 604 obstructs movement of the trigger protrusion 610 in the slotted opening 608 of the mounting plate 602. Specifically, in the illustrated example, pulling the trigger 106 causes the trigger protrusion 610 to contact a lower edge of the locking plate 604, thereby impeding continued movement of the trigger 106, and preventing the trigger searing surface 290 from releasing the piston searing surface 236.

The spring 616 is also coupled to the rod 606. As illustrated, the rod 606 extends in a longitudinal direction from an attachment 620 at the spring 616 to a distal end 622 on a side of the carriage 246 relatively closer to the barrel 102. The rod 606 also includes a biasing member 624 fixed along the length of the rod 606. In some instances, the rod 606 may be formed of a metal wire, such as music wire, although this disclosure is not so limited. In other examples the rod 606 may be a polymeric material, a composite material, or the like. In examples, the rod 606 is sufficiently rigid such that application of a force to the biasing member 624 in a longitudinal direction 626 causes the rod 606 to move longitudinally and with sufficient force to overcome the spring force of the spring 616.

In the example of FIG. 6A, the compression tube 206 is between the cocking position and the firing position, discussed above. For example, the actuator assembly may be returning the compression tube 206 to the firing position after moving the compression piston 208 to the cocked position. In this position, the spring 616, which is coupled to the locking plate 604, biases the locking plate 604 into the locking position, impeding actuation of the trigger 106, as described above.

In the example of FIG. 6B, the compression tube 206 has advanced to the firing position. In this position, the second end 256 of the carriage 246 has contacted the biasing member 624 and displaced the biasing member 624, and therefore the rod 606, generally in a longitudinal direction 626. The movement of the rod 606 overcomes the spring force of the spring 616, causing the locking plate 604 to slide, relative to the mounting plate 602 generally in the direction 626. With the locking plate 604 in this advanced position, the path of the trigger protrusion 610 in the slotted opening 608 is unobstructed. Pulling the trigger 106 with the locking plate in the advanced position results in disengagement of the trigger searing surface 290 with the piston searing surface 236, allowing the air gun 100 to be fired, as described above.

The air gun 100 is movable between multiple configurations, and, depending upon a current configuration, different components are located in different positions. For instance, in both the fired configuration 300 and the firing configuration 304, the compression tube 206 is in an advanced, firing position, in which the hollow probe 276 extends through the magazine 272, e.g., into the barrel 102. However, in the fired configuration 300 no projectile 270 is in the barrel whereas the projectile 270 is in the barrel 102 in the firing configuration 302. Moreover, in the cocking position 302, the hollow probe 276 does not extend through the magazine 272, but a projectile 270 may be in line with the barrel 102. As will be described now with reference to FIG. 7, aspects of the present disclosure allow for removal and/or reloading of the magazine 274 regardless of the current state of the air gun 100.

FIG. 7 is a schematic representation of a magazine 700 in a first magazine configuration 702, a second magazine configuration 704, and a third magazine configuration 706. More specifically, the magazine 700, which may be the magazine 274, includes a housing 708 and a carousel 710 disposed to rotate in and relative to the housing 708. In the depiction of the magazine 700 associated with the first configuration 702, a portion of the housing 708 is removed to illustrate the position of the carousel 710 in the housing 700. Moreover, for clarity in the following description, each representation of the magazine configurations 702, 704, 706 includes a separate depiction of the carousel 710, to show the position of the carousel relative to the housing 708.

In more detail, the housing 708 defines an opening 712, which, with the magazine 700 fixed to the air gun 100, generally aligns with the barrel 102. As discussed herein, the hollow probe 276 extends partially into the barrel 102 in the fired configuration 300 and the firing configuration 304. In those configurations, when the magazine 700 is used, the hollow probe 276 extends through the opening 712.

The carousel 710 generally includes a plurality of receptacles 714 and a shutter 716 circumferentially-spaced about a rotational axis 718. In the illustrated example, eight receptacles are shown, although more or fewer may be included in other arrangements. The shutter 716 generally comprises a solid wall or stop, as will be described further herein. Although not illustrated in FIG. 7, the magazine 700 further includes an indexer, which may be embodied as a spring-loaded ratchet pawl cooperating with a torsion spring or the like, that causes the carousel 710 to rotate about the rotational axis 718 to serially align the receptacles 714 and the shutter 716 with the opening 712 in the housing 708.

More specifically, the first magazine configuration 702 may be a loading configuration, e.g., in which the magazine 700 is first placed into the receptacle 272 of the air gun 100. In the first magazine configuration, a blank receptacle 714*a* of the receptacles 716 is aligned with the opening 712. In this configuration, the opening 712 is free of obstructions that could prevent the magazine 100 from being properly seated in the air gun 100 in either the fired configuration 300 or the firing configuration 304, e.g., in which the hollow probe 276 is extended into the barrel 102. Stated differently, the blank receptacle 714*a* allows for loading of the magazine 700 over the extended hollow probe 276, thereby obviating the need to cycle the air gun 100 to a position at which the hollow probe 276 is retracted. As will be appreciated, should the magazine 700 be loaded into the air gun 100 with the hollow probe 276 in the retracted position, the magazine 700 will automatically index to the second magazine configuration 704.

In the second magazine configuration 704, the carousel 710 has been indexed in the direction of an arrow 720 (relative to the position in the first magazine configuration 704) to present a loaded receptacle 714*b* of the receptacles 716 in line with the opening 712. Specifically, the loaded receptacle 714*b* contains a projectile 722, which may the projectile 270. With the projectile 722 in the opening 712, as the air gun cycles to the firing configuration 304, the projectile 722 is pushed out of the opening 712 into the barrel 102 as detailed herein. After firing, as the air gun cycles through the cocking configuration 302 and back to the firing configuration 304, the magazine 700 will again index to present a next one of the loaded receptacles 716*b* in line with the opening 712. As the magazine 700 indexes in this manner, a visual indicator 724 may be updated to show a remaining number of projectiles in the magazine 700. In one example, an opening or window 726 may be provided in the housing 708 and a printed indication 728 of a plurality of printed indications on the carousel 710 may align with the window 726 to be visible to a user.

As the projectiles 722 are fired from the air gun 100, the magazine 700 continues to index as just described. Upon firing of the last projectile 722, the magazine 700 indexes to the third magazine configuration 706. In this configuration, the shutter 716 aligns with the opening 712. As noted above, the shutter 716 is a solid wall and prevents the hollow probe 276 from passing through the opening 712. Because the air gun 100 cannot be advanced to the firing configuration 304 with the magazine 700 in the third magazine configuration 706, a user cannot continue to fire the air gun 100 without replacing the magazine 700. In the example illustrated, the visual indicator 724 includes an icon that alerts the user to the empty magazine 700. In some embodiments, the air gun 100 includes a current sensor that senses the current used in the motor, e.g., the motor of the rotary actuator 252, that drives the hollow probe 276 forward. When the shutter 716 closes the opening 712 and the hollow probe 276 drives against the shutter 716, the current in the motor changes and these changes can be sensed by a microprocessor connected to the sensor. When such changes are detected, the microprocessor reverses the current in the motor to withdraw the hollow probe 276, e.g., to return the air gun 100 to the cocking configuration 302 or some intermediate position between the firing position 304 and the cocking position 302. Optionally the microprocessor can also cause an audible, visual or tactile indicator to emit a signal indicating that the magazine 700 must be changed.

As will be appreciated from the foregoing, the magazine 700 may be coupled to the air gun 100 regardless of a state of the air gun 100. That is, the magazine 700 can be replaced with the hollow probe 276 extended or retracted. For example, circumstances may arise in which the hollow probe 276 has advanced a projectile into the bore of the air gun 100 but a user wishes to swap ammunition or to load a more fully loaded magazine onto the air gun 100 while maintaining a readiness to fire as loaded. In such cases the user must load the magazine 700 onto (or over) the hollow probe 276. Such replacement however is not possible with the shutter 716 positioned in the opening 712, nor is it possible if a projectile is positioned in the opening 712. Accordingly, the magazine 700 includes the blank receptacle 714*a* that functions as a passageway for the hollow probe 276. Thus, in the example of FIG. 7, the magazine 700 is rated for seven projectiles, but includes eight receptacles 714. As discussed above, the blank receptacle 714*a* is positioned between the shutter 716 and the first loaded receptacle 714*b*. As illustrated, however, the blank receptacle 714*a* may be similar in size and configuration to a loaded receptacle 714*b*. In these configurations, the blank receptacle 714*a* may facilitate loading of a separate, additional projectile into the air gun 100. Specifically, as noted above, when the hollow probe 276 is retracted, the magazine 700 will automatically index to align the first loaded receptacle 214*b* with the opening 212, because the hollow probe will not prevent this indexing. Instead of allowing such indexing, a user may elect to place a projectile to be received in the blank receptacle 214*a*, thereby facilitating loading of an additional round. In other examples, the blank receptacle 714*a* may be sized or shaped differently than the loaded receptacles 714*b*, e.g., to facilitate the magazine replacement process. For instance, the blank receptacle 714*a* can include magnets or shaped surfaces to help a user to more rapidly and precisely align the magazine 700 in the receptacle 272 during loading.

It will be appreciated that when loading the magazine 700 of the embodiment of FIG. 7, the carousel 716 must be rotated so that the shutter is moved. Conventionally, this has positioned one of the loaded receptacles 714*b* in line with the opening 712. Because the opening 712 is at the vertical bottom of the magazine 700, gravity can cause the projectile 722 disposed in the opening 712 to fall out while attempting loading. However, because the magazine 700 aligns the blank receptacle with the opening 712, there is no pellet to complicate the loading process.

In the embodiment illustrated in FIG. 7, the shutter 716 is integrated into the carousel 716. In other embodiments, however, a separate shutter, movable between a shutter blocking position and a shutter open position may be provided. For instance, such an alternative shutter can interact with the carousel 716 such that as the carousel 716 is moved after firing of a final stored projectile, the carousel 716 drives the shutter from the open position to the blocking position. In one such embodiment the shutter can have a catch that interferes with movement of a driving surface of the carousel such that rotation of the carousel 716 drives the shutter from the open position to the blocking position. Other forms of interaction can be used including but not limited to magnetic. In still other embodiments the magazine 700 and/or the shutter 716 may be driven by an actuator on the air gun 100, with the actuator being used to synchronize movement of the carousel as well as movement of shutter 100. In these alternative arrangements, the shutter 716 may be separate from the carousel 716 and/or the magazine 700, such that the hollow probe 276 remains obstructed from advancing into the barrel 102.

The foregoing has discussed components and functionality associated with the automatic-cocking air gun 100. In some aspects of this disclosure, the air gun 100 may also include features to facilitate ready assembly of the air gun 100. Specifically, FIG. 8 provides an end view 800 and a partial cross-sectional view 802 of a portion of the air gun 100 proximate the stock 104, not shown. More specifically, the FIG. 8 illustrates additional aspects of a retention block 804, which may be used in place of the retention block 278 discussed above. In this example, the housing 108 of the air gun 100 includes a first rail 806 and a second rail 808, which form part of a profiled or contoured inner surface of the housing, defining at least a portion of the chamber 202.

The retention block 804 has a profile that is configured to cooperate with the rails 806, 808. More specifically, the retention block 804 may be inserted into the chamber 202 by sliding the retention block 804 along the rails 806, 808. The retention block 804 may be secured in a desired longitudinal position using one or more fasteners 810, shown generally as set screws in FIG. 8. In this example, two fasteners 810 (per rail) are illustrated to secure the retention block 804 in the longitudinal direction, although more or fewer may be used. Any number and/or type of fasteners that facilitate securement of the retention block 804 with adequate force to prevent longitudinal motion of the retention block 804 during operation. Moreover, fasteners, like the fasteners 282, may be used to secure the retention block 804 relative to the housing 104, e.g., proximate a top of the retention block 804.

The retention block 804 includes an opening 812, which, in the example, is a threaded opening configured to receive the threaded plug 280. As illustrated, the threaded plug 280 contacts the rod 240 of the spring 210. The threaded plug 280 can be moved to increase/decrease a loading on the spring 210, e.g., by moving the rod 240. For example, with the air gun 100 in the fired position, the threaded plug 280 may be "tightened" relative to the opening 812 to increase a pre-loading on the spring 210. For example, the threaded plug 280 is illustrated as including a receptacle 814 configured to receive a tool for facilitating movement of the threaded plug 280 in the opening 812. With this arrangement, the spring 210, which, as discussed above, may be a gas spring, can be pre-loaded in the chamber 202, obviating the need for expensive and specialized equipment for pre-loading and calibrating the gas spring prior to assembly of the air gun 100.

As also shown in the example of FIG. 8, the retention block 804 can include a pair of spaced-apart legs 816 having contoured outer surfaces for cooperating with the rails 806, 808. The legs 816 may provide easier assembly, e.g., by allowing for some lateral movement of the legs 816, e.g., relative to each other, to account for manufacturing tolerances, or the like. In some examples, the spaced-apart legs 816 may include a lateral outward bias, such that the legs 816 must be moved laterally toward each other for insertion into the chamber 202 via the rails. In this example, the legs 816 may provide an outward force on the housing proximate the rail 806, 808, to increase a holding force of the retention block 804 in the chamber 202. Moreover, the spaced-apart legs 816 can define a cavity 818 therebetween. The cavity 818 may house components, e.g., cabling, leads, circuit boards, and/or other electronic and/or electro-mechanical components, or the like.

FIG. 8 also illustrates a stop block 820 secured to the rails 806, 808. In the example, the stop block 820 contacts a rear surface of the retention block 804 proximate the legs 816 and is secured to the rails 806, 808 via fasteners 822, which may be the same as the fasteners 810. The stop block 820 may be optional in some examples. Without limitation, the stop block 820 may be integrated into the retention block 804. Although not illustrated in FIG. 8, in some examples the legs 816 can incorporate slots to receive and locate a pin, such as a sear pivot pin, to secure aspects of the trigger link 288, and therefore the trigger searing surface 290, relative to the housing 108. The rails 806, 808 may also cooperate with the stop block 820 to support loads acting on the pin by the trigger linkage 288 when the piston 208 is seared. The stop block 820 may also provide mounting points for the trigger assembly 284 and also for the trigger lock assembly 600. The block 820 is secured to the rails 806 and 808 and may be in direct contact with the block 278. In this arrangement, the block 820 can assist the block 278 in anchoring the reaction force of the spring 210 to the housing 108.

The air gun 100 discussed herein provides improved automatic cocking that reduces user interaction. A process for cocking the air gun 100 was generally discussed above with reference to FIGS. 3A-3C. FIG. 8 and FIG. 9 illustrate additional example processes in accordance with embodiments of the disclosure. These processes are illustrated as logical flow graphs, each operation of which represents a sequence of operations that can be implemented in hardware, software, or a combination thereof. In the context of software, the operations represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described operations can be combined in any order and/or in parallel to implement the processes.

It should be appreciated that the subject matter presented herein may be implemented as a computer process, a computer-controlled apparatus, a computing system, or an article of manufacture, such as a computer-readable storage medium. In examples, the air gun 100 can include a control system for implementing the processes 900, 1000, 1100, as well as other functionality, of the air gun 100. For instance, the control system can include the sensors 412, 502, 506, the circuit board 414, the electronic components 416, and/or other components. While the subject matter described with respect to the process 800 and the process 900 are presented in the general context of operations that may be executed on and/or with one or more computing devices, those skilled in the art will recognize that other implementations may be performed in combination with various program/controller modules. Generally, such modules include routines, programs, components, data structures, and other types of structures that perform particular tasks or implement particular abstract data types.

Those skilled in the art will also appreciate that aspects of the subject matter described with respect to the process 900, the process 1000, and/or the process 1100 may be practiced on or in conjunction with other computer system configurations beyond those described herein, including multiprocessor systems, microprocessor-based or programmable consumer electronics, minicomputers, mainframe computers, handheld computers, mobile telephone devices, tablet computing devices, special-purposed hardware devices, network appliances, and the like.

More specifically, FIG. 9 is a flow diagram illustrating an example process 900 for operating an air gun, such as the air gun 100 with automatic cocking. In some examples, the process 900 may be performed by a controller, aspects of which may be retained in the stock 104.

The example process 900 includes, at an operation 902, confirming a magazine is loaded. For example, aspects of this disclosure may require that the magazine 274 be loaded in the magazine receptacle 272 for proper operation of the air gun 100, e.g., to confirm that the breach end 110 of the barrel 102 is not exposed. As shown in FIG. 5, the housing 108 can include a magazine sensor 502 configured to sense presence of the magazine 274. In some examples, the magazine 274 may have an integrated magnet 504 sensed by the magazine sensor 502.

At an operation 904, the process 900 includes, with the air gun in a fired position, controlling an actuator to move a compression tube toward a cocking position. For example, FIG. 3A shows the fired configured 300 in which the compression tube 206 is in the firing position, the compression piston 208 is the in the fired position, and the spring 210 is expanded. The operation 904 includes using the actuator to begin moving the compression tube 206 (and the compression piston 208) to compress the spring 210. In the example of the air gun 100, the actuator is the rotary actuator 252 configured to drive the drive screw 248, although in other examples, other actuators may be used. For example, aspects of the actuator assembly 244 can be replaced with one or more different servo, pneumatic, hydraulic or other actuators, including but not limited to linear servo actuators.

At an operation 906, the process 900 includes causing the piston to sear. For example, and as illustrated in FIG. 3B, with continued movement of the compression tube 206 to compress the spring 210, the piston searing surface 236 on the compression piston 208 will engage the trigger searing surface 290. This engagement places the compression piston 208 in the cocked position shown in FIG. 3B.

At an operation 908, the process 900 includes determining whether the piston travelled to the cocked position. For example, and as illustrated in FIGS. 4A and 4B, the air gun 100 includes the sensor 412 for determining that the compression piston 208 has reached the cocked position. As described herein, the sensor 412 may detect the presence of a probe 402 which moves into the detection field of the sensor 412 when contacted by the compression piston 208 during cocking.

If, at the operation 908 it is determined that the piston has travelled to the cocked position, the process 900 proceeds to an operation 910 including reversing the actuator. For example, because the compression tube 206 has reached a position at which the compression piston 208 is seared, the actuator will reverse direction to return the compression tube 206 to the firing position.

At an operation 912, the process 900 includes determining whether the piston remained in the cocked position. For example, the probe 402 detected by the sensor 412 is biased, e.g., via a spring, such that when the compression piston 208 is no longer in the cocked position, the probe 402 will return to a normal position spaced from the field of view of the sensor 412. Thus, for example, if the gun does not sear properly, and the compression piston 208 returns with the compression tube 208 during the movement of the actuator in the operation 910, the sensor 412 will detect an absence of the probe 402.

If it is determined at the operation 912 that the piston has remained in the cocked position, at an operation 914 the process 900 includes determining whether the compression tube has returned to the firing position. In the example of FIG. 5, the carriage 246, e.g., the sidewall 258 of the carriage 254, is sensed by the carriage sensor 506 when in the firing position. In that example, the sidewall 258 includes the magnet 508 that is sensed by the carriage sensor 506, although other examples are contemplated. The operation 914 can also be based at least in part on a time lapse. For instance, the process 900 may require that the compression tube 208 return to the firing position in a predetermined amount of time.

If it is determined at the operation 912 that the compression tube is returned to the firing position, at an operation 916 the process 900 can include stopping the actuator. As discussed above in connection with FIG. 5, the presence of the compression tube in the firing position, as detected by the carriage sensor 506, can signal that the air gun is in the firing position, causing the actuator to stop. As also discussed, an increased resistance to movement of the actuator, e.g., resulting from contact of the spring 262 by the screw drive nut 250, can be detected and cause the process 900 to stop the actuator.

At an operation 918, the process 900 can also include signaling ready to fire. For instance, the operation 918 can include controlling a user interface to indicate to a user that the air gun 100 is ready for firing. In some examples, an LED or other light source visible to the user may change from red to green or provide some other visual cue to indicate that the air gun 100 is ready for firing. Also, and as detailed above in connection with FIGS. 6A and 6B, the air gun 100 can include a trigger lock assembly that prevents pulling the trigger 106 until the compression tube is returned to the firing position. In other examples, the operation 918 can include removing an electronic trigger lock, providing an audible or tactile output corresponding to the ready to fire state, or the like.

If it is determined at the operation 908 that the piston has not travelled to the cocked position, at the operation 912 that the piston has not remained in the cocked position, and/or at the operation 914 that the compression tube has not returned to the firing position, the process 900 can proceed to an operation 920, at which an error is signaled. The operation 920 can include indicating to the user that the air gun 100 is malfunctioning, e.g. jammed or the like. Without limitation, the operation 920 can include providing a visual, audible, tactile, and/or other warning to the user that the air gun 100 is not ready for filing.

Figure 10:
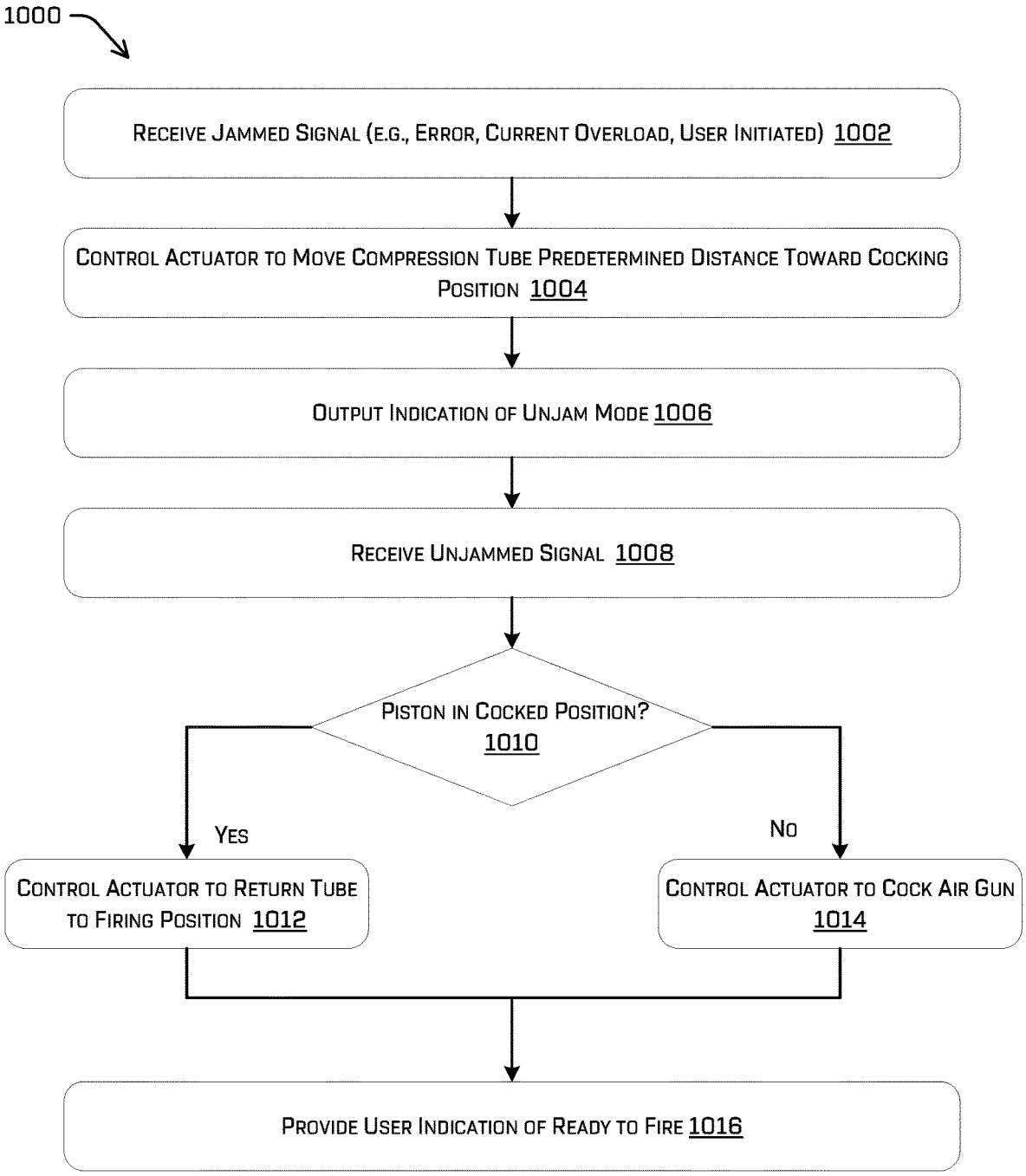
FIG. 10 is a flow chart showing additional operation of an automatically cocking air gun, according to examples of this disclosure.

In more detail, FIG. 10 shows a process 1000 for controlling an air gun in response to an error, such as the error determined at the operation 820. Although the process 1000 may be in response to the error at the operation 820, the process 1000 does not require the processing described above in connection with FIG. 8, and the process 800 need not result in implementation of the process 1000.

In more detail, at an operation 1002, the process 1000 includes receiving a jammed signal. In some examples, the jammed signal may be the error signal resulting from the operation 820. In other examples, the jammed signal may result from an increased resistance to movement of the actuator, e.g., as determined by an increased current load. In still further examples, the jammed signal may result from a user input. For instance, the air gun 100 can include a user interface, e.g., a button, switch, or the like, that the user can interact with to signal that the user would like to perform maintenance on the air gun 100 for example.

At an operation 1004, the process 1000 includes controlling an actuator to move a compression tube a predetermined distance toward a cocking position. For example, the operation 1004 can include moving the compression tube 206 via operation of the actuator 252 to a position in which the hollow probe 276 is spaced from the magazine 274. For example, in this "unjam" position, the magazine 274 can be removed from the magazine receptacle 272.

At an operation 1006, the process 1000 includes outputting an indication of unjam mode. For instance and without limitation, the operation 1006 can include providing a visual, audible, tactile, and/or other indication to the user that the air gun 100 is in the "unjam" position. For instance, the indication may indicate to a user that the user can perform maintenance, e.g., to clear a jam, replace a magazine, or the like.

At an operation 1008, the process 1000 includes receiving an unjammed signal. For example, once an obstruction is cleared, a magazine is replaced, or the like, the user may interact with a user interface to so indicate.

At an operation 1010, the process 1000 includes optionally determining whether a piston is in a cocked position. For instance, as detailed above, the probe 402 may be sensed by the sensor 412 when the compression piston 208 is in the cocked position. A state of the sensor 412 may be determined at the operation 1010.

If, at the operation 1010 it is determined that the piston is in the cocked position, an operation 1012 includes controlling the actuator to return to the firing position. For example, the operation 1012 can include moving the compression tube 208 to a position at which the carriage sensor 506 confirms presence of the magnet 508.

Alternatively, if at the operation 1010 it is determined that the piston is not in the cocked position, an operation 1014 includes controlling the actuator to cock the air gun. For example, regardless of a state of the air gun 100 prior to entering the "unjam mode," upon completion of unjamming the air gun 100, the air gun 100 may be placed in a cocked or ready to fire position. As noted, the operations 1010, 1012, and 1014 are optional. In other examples, the air gun 100 may be returned to a different configuration upon receiving the unjammed signal.

At an operation 1016, the process 1000 includes providing the user with an indication of ready to fire. For example, and without limitation, the operation 1016 can include configuring a user interface to indicate, e.g., visually, audibly, tactilely, or the like, that the air gun 100 is no longer jammed and/or ready to fire.

Figure 11:
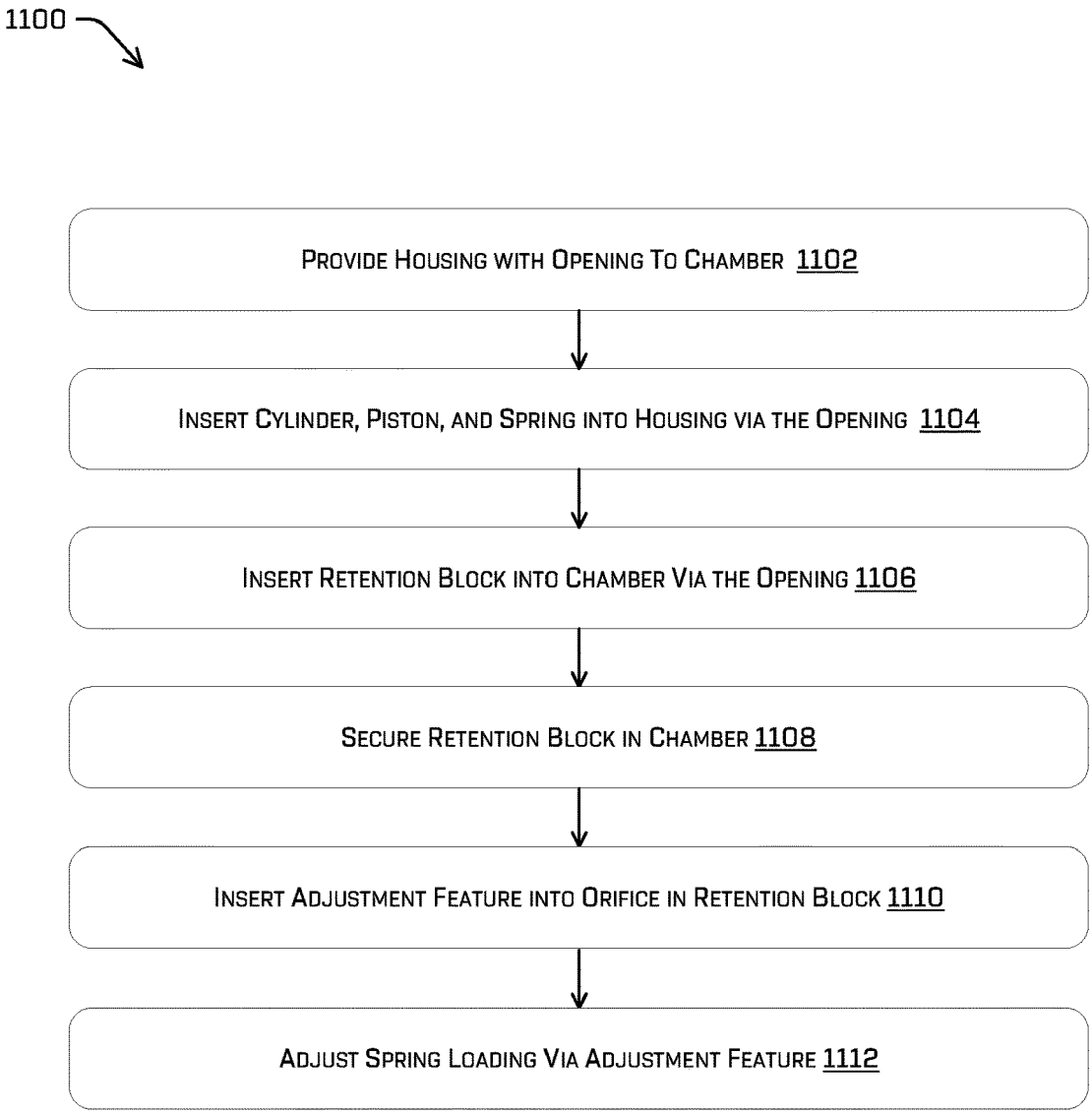
FIG. 11 is a flow chart showing a method of manufacturing an automatically cocking air gun, according to examples of this disclosure.

FIG. 11 provides an improved process 1100 of manufacturing an air gun, like the air gun 100. As with the processes 900, 1000, the process 1100 is illustrated as a series of steps in a flowchart. The order of the steps is for example only and the process 1100 may be implemented with more or fewer steps.

At an operation 1102, the process 1100 includes providing a housing with an opening to a chamber. For example, as shown in FIG. 8, the air gun 100 can include the housing 108 including the chamber 202, at least partially defined by the chamber wall 200. The chamber wall 200 can be profiled, e.g., to include the rails 806, 808.

At an operation 1104, the process 1100 includes inserting a cylinder, a piston, and a gas spring into the housing via the opening. As detailed herein, the compression tube 206 is configured for insertion into the chamber 202 and for movement relative to the chamber 202. Similarly, the compression piston 208 is at least partially received in the open end of the compression tube 206, and the spring 210 is positioned to bias the compression piston 208 toward the compression tube 206. In the example of FIGS. 2 and 8, the compression tube 206, the compression piston 208, and the spring 210 are inserted, in order, and generally along the longitudinal axis 211 into the chamber 202.

At an operation 1106, the process 1100 includes inserting a retention block into the housing via the opening. In examples, with the compression tube 206, the compression piston 208, and the spring 210 inserted in the chamber in the operation 1104, the retention block is inserted into the chamber 200. In the example of FIG. 8, the retention block 820 is inserted into the chamber 202 in a longitudinal direction, along the rails 806, 808. The operation 1006, or another operation, may in some instances include sliding, as an assembly, the retention block 820, the trigger group 284 and the trigger lock 600 into the cavity 818 and onto rails 806 and 808 of the housing 108.

At an operation 1108, the process 1100 includes securing the retention block in the chamber. In the example of FIG. 8, discussed above, the retention block 802 is retained by one or more of the fasteners 810, which may be threaded fasteners that pass through the retention block 802 and contact the rails 806, 808. Other fasteners, including mechanical fasteners, adhesives, or the like, also or alternatively may be used.

At an operation 1110, the process 1100 includes inserting an adjustment feature into an orifice in the retention block. In the example of FIG. 8, the retention block 802 includes the opening 812 into which the plug 280 is threaded. The plug 280 contacts the spring 210.

At an operation 1112, the process 1100 includes adjusting the spring loading using the adjustment feature. For example, by selectively moving the plug 280 along the longitudinal axis 211, e.g., by turning the threaded plug 280, the spring 210 can be selectively compressed or expanded, with the spring contained in the chamber 202. In examples, the process 1100 obviates the need for expensive and elaborate fixtures and tools for setting the spring tension prior to inserting the spring into the air gun. Moreover, the arrangements described herein provide for ready disassembly, e.g., for maintenance and/or repair of components of the air gun 100.

The subject matter described above is provided by way of illustration only and should not be construed as limiting. Furthermore, the claimed subject matter is not limited to implementations that solve any or all disadvantages noted in any part of this disclosure. Various modifications and changes may be made to the subject matter described herein without following the examples and applications illustrated and described, and without departing from the spirit and scope of the present invention, which is set forth in the following claims.

We claim:

1. An air gun comprising:

a housing defining a chamber;

a barrel extending from and in communication with the chamber; and a cocking mechanism at least partially disposed in the chamber and configured to prepare the gun to fire a projectile from the barrel, the cocking mechanism comprising:

a compression tube comprising a sidewall extending between a closed end and an open end and defining a compression tube volume, the compression tube being disposed in the chamber and movable relative to the chamber between a firing position and a cocking position;

a piston having a piston sidewall extending between a first piston end and a second piston end and a sear proximate the second piston end, the piston extending through the open end of the compression tube such that the first piston end is disposed in the compression tube volume and the piston being movable between a cocked position and a fired position;

a spring in communication with the piston and configured to bias the piston toward the fired position; and an actuator assembly for moving the compression tube between the firing position and the cocking position, the actuator assembly comprising:

a lead screw having a longitudinal axis;

an actuator coupled to the lead screw and configured to rotate the lead screw about the longitudinal axis; and a carriage coupled to the compression tube and movable along the lead screw, wherein, with the compression tube in the firing position and the piston in the fired position, the actuator causes the carriage to move the compression tube to the cocking position, movement of the compression tube to the cocking position causing the piston to compress the spring such that the searing surface engages with a trigger to secure the piston in the cocked position, and wherein, with the piston secured in the cocked position, the actuator causes the compression tube to return to the firing position.

2. The air gun of claim 1, further comprising a hollow probe extending from the closed end of the compression tube in a direction away from the compression tube volume, the hollow probe defining a channel in fluid communication with the compression tube volume.

3. The air gun of claim 2, wherein, with the compression tube in the firing position, the probe is sealed relative to the barrel, such that the channel is in fluid communication with the barrel.

4. The air gun of claim 3, wherein actuating the trigger with the piston in the cocked position and the compression tube in the firing position causes the piston to move toward the barrel, forcing air in the compression tube volume through the channel and into the barrel.

5. The air gun of claim 1, further comprising:

a carriage sensor a sensor proximate the barrel to detect that the compression tube is in the firing position.

6. The air gun of claim 1, further comprising:

a receptacle proximate a junction of the housing and the barrel, the receptacle configured to receive a magazine storing one or more projectiles for firing through the barrel; and a sensor proximate the receptacle to detect a presence of the magazine in the receptacle.

7. The air gun of claim 1, further comprising a piston sensor disposed proximate the stock and configured to detect a presence of the piston in the cocked position.

8. The air gun of claim 1, further comprising a trigger lock, the trigger lock comprising:

a locking plate biased into a locking position obstructing motion of the trigger; and a biasing member that, when contacted by the carriage, causes the locking plate to move to a second position spaced from the locking position, wherein the motion of the trigger is unobstructed by the locking plate in the second position.

9. The air gun of claim 1, wherein the chamber includes a contoured chamber wall comprising at least one rail, the air gun further comprising:

a retention block cooperating with the at least one rail and secured in the chamber, the retention block having an opening; and an adjustment feature disposed in the opening in the retention block, the adjustment feature contacting the spring and being adjustable to adjust a compression of the spring.

10. The air gun of claim 9, wherein the adjustment feature is a threaded plug and the opening in retention block is a threaded opening.

11. The air gun of claim 9, wherein the spring is a gas spring, and the adjustment feature is movable to adjust a loading of the gas spring.

12. An actuator assembly for an air gun, comprising:

a lead screw having a longitudinal axis generally parallel to a barrel of the air gun;

an actuator coupled to the lead screw and configured to rotate the lead screw about the longitudinal axis;

a lead screw nut threadedly engaged with the lead screw; and a carriage coupled to a compression tube and disposed in a path of the lead screw nut such that movement of the lead screw causes the lead screw nut to move the carriage and the compression tube.

13. The actuator assembly of claim 12, wherein:

the actuator actuates the lead screw to move the compression tube between a firing position and a cocking position.

14. The actuator assembly of claim 12, wherein the carriage comprises a first end spaced from a second end in a longitudinal direction, wherein the lead screw nut is disposed, in the longitudinal direction, between the first end and the second end.

15. The actuator assembly of claim 14, further comprising a spring disposed, in the longitudinal direction, between the lead screw nut and the second end of the carriage.

16. The actuator assembly of claim 12, further comprising a plurality of gears configured to cause the lead screw to rotate at a rate slower than a shaft of the actuator.

17. A method of operating an air gun comprising a cocking mechanism and an actuator assembly, the cocking mechanism comprising:

a compression tube movable between a firing position and a cocking position;

a piston extending through an open end of the compression tube and movable between a cocked position and a fired position; and a spring in communication with the piston and configured to bias the piston toward the fired position, and the actuator assembly for moving the compression tube between the firing position and the cocking position, the actuator assembly comprising:

a lead screw having a longitudinal axis generally parallel to the barrel;

an actuator coupled to the lead screw and configured to rotate the lead screw about the longitudinal axis; and a carriage coupled to the compression tube and movable along the lead screw, the method comprising:

controlling, with the compression tube in the firing position and the piston in the fired position, the actuator to cause the carriage to move the compression tube to the cocking position, movement of the compression tube to the cocking position causing the piston to compress the spring such that a searing surface engages with a trigger to secure the piston in the cocked position, and controlling, with the piston secured in the cocked position, the actuator to cause the carriage to move the compression tube to the firing position.

18. The method of claim 17, further comprising:

providing, with the piston in the cocked position and the compression tube in the firing position, an indication to a user that the air gun is ready to be discharged.

19. The method of claim 17, further comprising:

determining, based at least in part on first sensor data, that the piston is in the cocked position; and determining, based at least in part on second sensor data, that the compression tube is in the firing position.

20. The method of claim 19, further comprising:

determining, based at least in part on third sensor data, that a magazine is coupled to the air gun.

* * * * *